US006783927B2

(12) United States Patent
Yoshioka

(10) Patent No.: US 6,783,927 B2
(45) Date of Patent: Aug. 31, 2004

(54) PHOTOTHERMOGRAPHIC MATERIAL

(75) Inventor: Yasuhiro Yoshioka, Minami Ashigara (JP)

(73) Assignee: Fuji Photo Film, Co., Ltd., Kanagawa (JP)

( * ) Notice: Subject to any disclaimer, the term of this patent is extended or adjusted under 35 U.S.C. 154(b) by 0 days.

(21) Appl. No.: 09/899,261

(22) Filed: Jul. 6, 2001

(65) Prior Publication Data

US 2002/0042034 A1 Apr. 11, 2002

(30) Foreign Application Priority Data

Jul. 7, 2000 (JP) ..... P2000-206560

(51) Int. Cl.[7] ..... G03C 1/498; G03C 1/38

(52) U.S. Cl. ..... 430/631; 430/607; 430/610; 430/619; 430/965

(58) Field of Search ..... 430/619, 631, 430/607, 610, 965

(56) References Cited

U.S. PATENT DOCUMENTS 3,544,336 A * 12/1970 Milton
5,698,380 A * 12/1997 Toya ..... 430/363
5,766,835 A * 6/1998 Matsunaga ..... 430/523
5,939,248 A * 8/1999 Kirk et al. ..... 430/619
5,958,668 A * 9/1999 Matsumoto et al. ..... 430/619
5,989,796 A * 11/1999 Moon
6,287,754 B1 * 9/2001 Melpolder et al. ..... 430/527
6,423,487 B2 * 7/2002 Naoi ..... 430/619

* cited by examiner

*Primary Examiner*—Thorl Chea
(74) *Attorney, Agent, or Firm*—Birch, Stewart, Kolasch & Birch, LLP

(57) ABSTRACT

A photothermographic material is described which comprises a support having provided on one surface thereof at least one kind of a light-sensitive silver halide, a light-insensitive organic silver salt, a reducing agent for silver ions, and a binder, wherein the photothermographic material comprises the surface active agent represented by the following formula (F):

$$\left[Rf\text{—}(Rc)_n\right]_m\text{—}Z \qquad (F)$$

wherein Rf represents a perfluoroalkyl group, Rc represents an alkylene group, Z represents a group having an anionic group, a cationic group, a betaine-series group, or a nonionic polar group necessary for imparting a surface activity, n represents an integer of 0 or 1, and m represents an integer of 1, 2 or 3. The photothermographic material can remarkably prevent attaching of dust, etc., which become the case of forming white spots after heat development.

7 Claims, No Drawings

PHOTOTHERMOGRAPHIC MATERIAL

FIELD OF THE INVENTION

The present invention relates to a photothermographic material.

BACKGROUND OF THE INVENTION

Recently, in a medical treatment diagnosis film field and a photomechanical film field, from the viewpoints of the environmental safety and the space saving, the reduction of the amount of the processing waste liquids has been strongly demanded. Thus, the technique about photothermographic materials as a medical treatment diagnosis film and a photomechanical film, which can be efficiently exposed by a laser image setter or a laser imager and can form clear black images having a high resolution and a high sharpness, has been required. According to these photothermographic materials, solution-type processing chemicals are not required, and a heat-development processing system, which is simpler and does not spoil the environment, can be provided to customers.

In general image-forming material field, there is the same requirement, but in particular, because the images for the medical treatment diagnosis are required to have minute depictions, images having excellent sharpness and graininess are necessary and it is preferred to have images in a blue black tone from the view point of ease of diagnosis. At present, various hard copy systems utilizing pigments, dyes, etc., such as an ink jet printer, an electrophotography, etc., have been mainly used as general image-forming systems but there are no systems, which can be satisfactorily used as an output system for medical treatment systems.

On the other hand, thermal image forming systems utilizing organic silver salts are described, for example, in U.S. Pat. Nos. 3,152,904 and 3,457,075; D. Klosterboer, *Thermally processed Silver Systems* (*Imaging Processes and Material*), Neblette, the 8th edition, J. Sturge, V. Walworth, and A. Shepp edited, Chapter 9, page 279, 1989). In particular, a photothermographic material generally has a light-sensitive layer containing photocatalyst of a catalytic-active amount (for example, a silver halide), a reducing agent, a reducible silver salt (for example, an organic silver salt), and, if necessary, a color toning agent of controlling the color tone of silver, dispersed in a binder matrix. The photothermographic material is, after imagewise exposure, heated to a high temperature (for example, at least 80° C.) and forms black silver images by the redox reaction between the reducible silver salt (functions as an oxidizing agent) and the reducing agent. The redox reaction is accelerated by the catalytic action of the latent image of the silver halide generated by the light exposure. Thus, the black silver image is formed in the light-exposed region. They are disclosed in many literatures such as U.S. Pat. No. 2,910,377, JP-B-43-4924 (The term "JP-B" as used herein means an "examined Japanese patent publication"), etc.

On the other hand, for producing the photothermographic materials at a high speed and stably, it is important to control the properties of the coating solution with a surface active agent. As the problems for the production, there are the problems of the coating properties such as repelling and face roughening and the problems by attaching of foreign matters such as dust, etc. In these problems, it is described in JP-A-10-197985 (The term "JP-A" as used herein means an "unexamined published Japanese patent application") that a fluorine-based surface active agent is effective for the improvement of the occurrence of repelling and face roughening. However, about the problem of attaching of foreign matters such as dust, etc., the improvement is not in the sufficiently satisfying level.

SUMMARY OF THE INVENTION

The present invention serves to solve the problems of the conventional techniques described above. That is, the present invention provides a photothermographic material excellent in the heat-developing property and image stock stability, which prevents the attachment of foreign matters such as dust, etc., causing white spots (a white spot is determined by visual observance using a magnifying lens on a Shaukasten wherein the sample has a density of 2.0) after heat development.

As the result of intensively investigating the above-described problems, the present inventors have found that by using a surface active agent having a definite structure, the excellent photothermographic material giving the desired effects can be provided and have accomplished the present invention.

That is, according to the invention, a photothermographic material comprising a support having provided on one surface thereof at least one kind of a light-sensitive silver halide, a light-insensitive organic silver salt, a reducing agent for a silver ion, and a binder, wherein the photothermographic material comprises a surface active agent represented by the following formula (F) is provided,

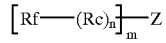

(F)

wherein Rf represents a perfluoroalkyl group, Rc represents an alkylene group, Z represents a group having an anionic group, a cationic group, a betaine-series group, or a nonionic polar group necessary for imparting a surface activity, n represents an integer of 0 or 1, and m represents an integer of 1, 2 or 3.

In the above-described photothermographic material, it is preferable that the reducing agent is a reducing agent represented by the following formula (I):

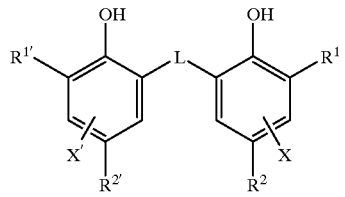

(I)

wherein $R^1$ and $R^{1'}$ each independently represents an alkyl group having from 1 to 20 carbon atoms, $R^2$ and $R^{2'}$ each independently represents a hydrogen atom, or a substituent capable of being substituted to the benzene ring, L represents an —S— group or a —$CHR^3$— group, wherein $R^3$ represents a hydrogen atom or an alkyl group having from 1 to 20 carbon atoms, and X and X' each independently represents a hydrogen atom or a substituent capable of being substituted to the benzene ring.

Also, it is preferable that the photothermographic material of the invention further comprises a compound represented by the following formula (II):

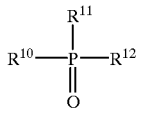

(II)

wherein $R^{10}$, $R^{11}$, and $R^{12}$ each independently represents an alkyl group, an aralkyl group, an aryl group, an alkoxy group, an aryloxy group, an amino group, or a heterocyclic group.

It is preferable that the photothermographic material of the invention further comprises a compound represented by the following formula (III):

$$Q—(Y)_n—C(Z^1)(Z^2)X \quad (III)$$

wherein Q represents an alkyl group, an aryl group, or a heterocyclic group, Y represents a divalent connecting group, n represents 0 or 1, $Z^1$ and $Z^2$ each represents a halogen atom, and X represents a hydrogen atom or an electron attractive group.

DETAILED DESCRIPTION OF THE INVENTION

Then, the present invention is described in detail.

First the compound represented by the formula (F) is explained in datail.

In the formula (F), Rf preferably represents a perfluoroalkyl group having from 3 to 20 carbon atoms and as the specific examples, there are a $C_3F_7$— group, a $C_4F_9$— group, a $C_6F_{13}$— group, a $C_8F_{17}$— group, a $C_{12}F_{25}$— group, a $C_{16}F_{33}$— group, etc.

The compound represented by the formula (F) may be a compound having two or more perfluoroalkyl groups different in chain length from each other as Rf or may be a compound having a single perfluoroalkyl group as Rf. When the compound has two or more perfluoroalkyl groups different in chain length from each other, the average of chain length of perfluoroalkyl groups is preferably 4 to 10 carbon atoms and particularly preferably 4 to 9 carbon atoms.

In the formula (F), Rc represents an alkylene group. The carbon atom(s) of alkylene group is 1 or more, preferably 2 or more and 20 or less, and as the specific examples, there are ethylene, 1,2-propylene, 1,3-propylene, 1,2-butylene, 1,4-butylene, 1,6-hexylene, 1,2-octylene, etc.

n represents an integer of 0 or 1, and n preferably represents 1.

m represents an integer of 1, 2 or 3. When Z is not a phosphoric acid ester group, m preferably is 1, and when Z represents a phosphoric acid ester group, the surface active agent may be a compound wherein m represents 1, 2 or 3 or a mixture of compounds m's of which represent 1, 2 and 3 with the proviso that the average of m's is preferably 1 to 2.

In the formula (F), Z represents a group having an anionic group, a cationic group, a betaine-series group, or a nonionic polar group necessary for imparting a surface activity and there is no particular restriction on the manner of bonding to Rc if Z contains the above-described group.

Examples of the anionic group necessary for imparting a surface activity include a sulfonic acid group and the ammonium salts or the metal salts thereof, a carboxylic acid group and the ammonium salts or the metal salts thereof, a phosphonic acid group and the ammonium salts or the metal salts thereof, a sulfuric acid ester group and the ammonium salts or the metal salts thereof, and a phosphoric acid ester group and the ammonium salts or the metal salts thereof.

Examples of the cationic group necessary for imparting a surface activity include quaternary alkyl ammonium groups such as a trimethylammoniumethyl group, a trimethylammoniumpropyl group, etc., and aromatic ammonium groups such as a dimethylphenylammoniumalkyl group, an N-methylpyridinium group, etc. These groups each has a proper counter ion such as a halogen atom, a benzenesulfonate anion, a toluenesulfonate anion, etc., and the toluenesulfonate anion is preferred.

Examples of the nonionic polar group necessary for imparting a surface activity include polyoxyalkylene groups and polyhydric alcohol groups, and the polyoxyalkylene groups such as polyethylene glycol, polypropylene glycol, etc., are preferred. An end-group of these groups may be a group other than a hydrogen atom, for example, an alkyl group.

In the formula (F) described above, Rf is preferably a perfluoroalkyl group having from 4 to 16 carbon atoms, and more preferably a perfluoroalkyl group having from 6 to 16 carbon atoms. Rc is preferably an unsubstituted alkylene group having from 2 to 16 carbon atoms, more preferably an unsubstituted alkylene group having from 2 to 8 carbon atoms, and particularly preferably an ethylene group. n preferably represents 1. The Rc group may be bonded to the group necessary for imparting a surface activity in Z by any bonding form, such as they may be bonded directly or may be bonded via an alkylene group, an arylene group, etc., which may have a substituent and/or may have an oxy group, a thio group, a sulfonyl group, a sulfoxido group, a sulfonamido group, an amido group, an amino group, a carbonyl group, etc., at the main chain or a side chain.

Then, a specific example of the surface active agent represented by the formula (F) is shown below, but the invention is not limited to them.

Anionic Surface Active Agents

| | |
|---|---|
| FS-1 | $C_8F_{17}CH_2CH_2SO_3^-Li^+$ |
| FS-2 | $C_8F_{17}CH_2CH_2SO_3^-Na^+$ |
| FS-3 | $C_8F_{17}CH_2CH_2SO_3^-K^+$ |
| FS-4 | $C_6F_{13}CH_2CH_2SO_3^-K^+$ |
| FS-5 | $C_{10}F_{21}CH_2CH_2SO_3^-Li^+$ |
| FS-6 | $C_8F_{17}CH_2CH_2SCH_2COO^-Na^+$ |
| FS-7 | $C_8F_{17}CH_2CH_2OCH_2COO^-K^+$ |
| FS-8 | $C_8F_{17}CH_2CH_2SCH_2CH_2COO^-Na^+$ |
| FS-9 | $C_8F_{17}CH_2CH_2SCH_2CH_2COO^-Li^+$ |
| FS-10 | $C_8F_{17}CH_2COO^-K^+$ |
| FS-11 | $F(CF_2CF_2)_nCH_2CH_2SO_3^-Na^+$ n = 3–7 |

-continued

FS-12 $F(CF_2CF_2)_nCH_2CH_2SO_3^-Li^+$ n = 3–7

FS-13 $C_8F_{17}CH_2CH_2SO_2N(C_3H_7)(CH_2CH_2O)_4(CH_2)_4SO_3^-Na^+$

FS-14 $F(CF_2CF_2)_nCH_2CH_2O(CH_2CH_2O)_x(CH_2)_4—SO_3^-Na^+$
n = 1–7, x = 4

FS-15 $C_8F_{17}CH_2CH_2OPO(O^-Na^+)_2$

FS-16 $C_8F_{17}CH_2CH_2SO_2N(C_3H_7)CH_2COO^-Na^+$

FS-17 $C_8F_{17}CH_2CH_2SO_2N(C_3H_7)CH_2CH_2OPO(O^-Na^+)_2$

FS-18 $[F(CF_2CF_2)_nCH_2CH_2O]_xPO(O^-M^+)_y$ $M^+ = H^+, NH_4^+, Na^+, Li^+$
x + y = 3, n = 1–7

FS-19 $[F(CF_2CF_2)_nCH_2CH_2O]_xPO(O^-M^+)_y(OCH_2CH_2OH)_z$
$M^+ = H^+, NH_4^+, Na^+, Li^+$
x + y + z = 3, n = 1–7

FS-20 $F(CF_2CF_2)_nCH_2CH_2SO_3^-M^+$ $M^+ = H^+, NH_4^+, Li^+, Na^+, K^+$ n = 1–9

FS-21 $C_6F_{13}CH_2CH_2SO_3^-M^+$ $M^+ = H^+, NH_4^+, Li^+, Na^+, K^+$

FS-22 $F(CF_2CF_2)_nCH_2CH_2SCH_2CH_2COO^-Li^+$ n = 1–9

Cationic Surface Active Agents

FS-23

$C_8F_{17}CH_2CH_2SO_2NHCH_2CH_2CH_2N^+(CH_3)_3$ 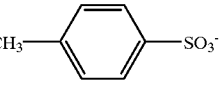

FS-24

$C_6F_{13}CH_2CH_2NHCH_2CH_2N^+(CH_3)_3$ 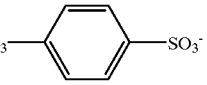

FS-25

$C_8F_{17}CH_2CH_2SO_2NHCH_2CH_2CH_2OCH_2CH_2N^+(CH_3)_3$ 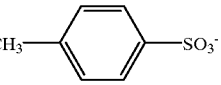

FS-26

$F(CF_2CF_2)_nCH_2CH_2SO_2NHCH_2CH_2CH_2N^+(CH_3)_3$ n = 1-7 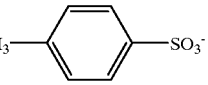

FS-27

$F(CF_2CF_2)_nCH_2CH_2SO_2NHCH_2CH_2CH_2OCH_2CH_2N^+(CH_3)_3$ n = 1–7 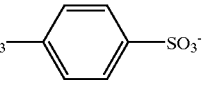

FS-28 $F(CF_2CF_2)_nCH_2CH_2N^+(CH_3)_3Cl^-$ n = 1–9

FS-29 $F(CF_2CF_2)_nCH_2CH_2NHCH_2CH_2N^+(CH_3)_3I^-$ n = 1–7

Nonionic Surface Active Agents

FS-30 $C_6F_{13}CH_2CH_2O(CH_2CH_2O)_nH$ n = 5–10

FS-31 $C_8H_{17}CH_2CH_2O(CH_2CH_2O)_nH$ n = 10–15

FS-32 $C_8F_{17}CH_2CH_2O(CH_2CH_2O)_nH$ n = 15–20

FS-33 $C_{10}F_{21}CH_2CH_2O(CH_2CH_2O)_nH$ n = 15–20

FS-34 $C_8F_{17}CH_2CH_2SO_2N(C_3H_7)CH_2CH_2O(CH_2CH_2O)_nH$ n = 15

FS-35 $F(CF_2CF_2)_mCH_2CH_2O(CH_2CH_2O)_nH$ m = 3–7, n = 5–10

FS-36 $C_8F_{17}CH_2CH_2SO_2N(C_2H_5)(CH_2CH_2O)_nH$ n = 5–10

-continued

FS-37

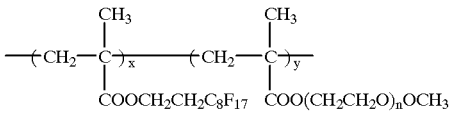

x/y = 20/80
n = 5–10

FS-38 $F(CF_2CF_2)_nCH_2CH_2O(CH_2CH_2O)_xH$ n = 1–7, x = 0–15
FS-39 $F(CF_2CF_2)_nCH_2CH_2O(CH_2CH_2O)_xH$ n = 1–9, x = 0–25
FS-40 $F(CF_2CF_2)_nCH_2CH_2S(CH_2CH_2O)_xH$ n = 1–9, x = 0–25

FS-41 $C_6F_{13}CH_2CH_2SO_2N(C_3H_7)CH_2CH_2O(CH_2CH_2O)_xH$ x = 0–15

Betaine-Series Surface Active Agent

FS-42 $C_8F_{17}CH_2CH_2SO_2NH(CH_2)_3N^+(CH_3)_2CH_2CH_2COO^-$

For the compounds represented by the formula (F) according to the present invention, commercially available compounds as so-called telomer type perfluoroalkyl group-containing surface active agents can be used. The examples of inonic compounds include Zonyl® FSP, FSE, FSJ, NF, TBS, FS-62, FSA, and FSK (the products of E. I. Du Pont de Nemours); S-111, S-112, S-113, S-121, S-131, and S-132 (the products of Asahi Glass Company Ltd.); and Unidyne DS-101, DS-102, DS-202 and DS-301 (the products of Daikin Industries, Ltd.). The examples of noninonic compounds include Zonyl® 9075, FSO, FSN, FS-300, and FS-310 (the products of E. I. Du Pont de Nemours); S-141 and S-145 (the products of Asahi Glass Company Ltd.); and DS-401 and DS-403 (the products of Daikin Industries, Ltd.).

Among the above-described various compounds, the ionic surface active agents can be used in the form of salts with various different counter ion by means of ion exchange or neutralization, taking the purpose of use, solubility to be required or the like into consideration.

The fluorine-based surface active agents represented by the formula (F) may be used singly or as a combination of two or more kinds thereof. The fluorine-based surface active agents represented by the formula (F) for use in the present invention can be incorporated into any layer in photothermographic material. For the purpose, the surface active agent may be added to the coating solution for the layer. For example, the fluorine-based surface active agents can be incorporated into a light-sensitive layer, an interlayer, a surface protective layer, a back layer, and a protective layer for the back layer, and the like, and particularly preferably the surface protective layer or the protective layer for the back layer. The amount of the fluorine-based surface active agent represented by the formula (F) used for each side of the front side and back side is in the range of preferably from 0.1 to 200 mg/m$^2$, more preferably from 0.5 to 50 mg/m$^2$, and still more preferably from 1 to 30 mg/m$^2$.

The photothermographic material of the invention comprises a light-insensitive organic silver salt. The organic silver salt, which can be used in the invention, is a silver salt, which is relatively stable to light but forms a silver image in the case of being heated to 80° C. or higher in the presence of a light-exposed photocatalyst (a latent image of a light-sensitive silver halide) and a reducing agent. The organic silver salt may be an optional organic substance containing a source capable of reducing a silver ion. Such light-insensitive organic silver salts are described in. paragraph numbers 0048 to 0049 of JP-A-10-62899, EP-A-0803764, page 18, line 24 to page 19, line 37 and EP-A-0962812. The silver salts of organic acids, and particularly the silver salts of long chain aliphatic carboxylic acids (having from 10 to 30, and preferably from 15 to 28 carbon atoms) are preferred. Preferred examples of the organic silver salt include silver behenate, silver arachidinate, silver stearate, silver oleate, silver laurate, silver caproate, silver myristate, silver palmitate, and the mixture of them. In the invention, in these organic silver salts, the use of organic acid silver having a content of silver behenate of at least 75 mol % is preferred.

There is no particular restriction on the form of the organic silver salt, which can be used in the invention, the form may be an acicular form, a rod form, a tabular for, or a flaky form.

In the invention, a flaky organic silver salt is preferred. The term "a flaky organic silver salt" as used herein is defined as follows. When an organic acid silver salt is observed by an electron microscope, the form of the organic acid silver salt grain is approximated to a rectangular parallelepiped, and the sides of the rectangular parallelepiped are shown by a, b, and c (c may be same as b) from the shortest side, by calculating by the short values a and b, x is obtained as follows;

$$x=b/a$$

By calculating as described above, on about 200 grains, x's are obtained, and when the mean value thereof is defined as x (average), the form of the grains satisfying the relation of x (average)≧1.5 is defined as a flaky form. The flaky form in the invention is preferably 0≧x (average)≧1.5, and more preferably 20≧x (average)≧2.0. Incidentally, an acicular form is 1≦x (average)<1.5.

In the flaky grain, "a" can be regarded as the thickness of a tabular grain wherein the plane having "b" and "c" as the sides is the main plain. The average of "a" is preferably 0.01 μm or longer but 0.23 μm or shorter, and more preferably 0.1 μm or longer but 0.20 μm or shorter. The average of c/b is preferably 1 or higher but 6 or lower, more preferably 1.05 or higher but 4 or lower, still more preferably 1.1 or higher but 3 or lower, and particularly preferably 1.1 or higher but 2 or lower.

The grain size distribution of the organic silver salt is preferably a monodispersed distribution. In the monodispersed distribution, the percentage of the value obtained by dividing the standard deviation of each length of the short axis and the long axis by each of the short axis and the long axis is preferably not higher than 100%, more preferably not higher than 80%, and still more preferably not higher than 50%. As the measurement method of the form of the organic silver salt, the form can be obtained by the transmission-type electron microscopic images of the organic silver salt dispersion. As other method of measuring the monodispersed property, there is a method of obtaining the standard deviation of the volume load mean diameter of an organic silver salt, and the percentage of the value (variation coefficient) obtained by dividing the standard deviation of the volume load mean diameter by the volume load mean diameter is preferably not higher than 100%, more preferably not higher than 80%, and still more preferably not higher than 50%. As the measurement method, the percentage can be obtained from the grain size (volume load mean diameter) obtained, for example, by irradiating an organic silver salt dispersed in a liquid with a laser light, and by determining the self correlation function to the time change of swinging of the scattered light thereof.

As the production method of the organic silver salt, which is used in the invention, and the dispersing method thereof, known methods can be applied. For example, the descriptions of JP-A-10-62899, EP-A-0803763, and EP-A-0962812 described above can be referred.

In addition, when a light-sensitive silver salt exists at the dispersion of the organic silver salt, the formation of fog is increased and the sensitivity is greatly lowered, and hence it is preferred that at dispersing the organic silver salt, the system does not substantially contain a light-sensitive silver salt. In the invention, the amount of the light-sensitive silver salt in the aqueous dispersion to be dispersed is not more than 0.1 mol % to mol of the organic silver salt in the dispersion, and the positively addition of a light-sensitive silver halide to the aqueous dispersion is not carried out in the invention.

In the invention, it is possible to product a light-sensitive material by mixing an aqueous dispersion of the organic silver salt and an aqueous dispersion of a light-sensitive silver halide, the mixing ratio of the organic silver salt and the light-sensitive silver salt can be selected according to the purpose, but the ratio of the light-sensitive silver salt to the organic silver salt is in the range of preferably from 1 to 30 mol %, more preferably from 3 to 20 mol %, and particularly preferably from 5 to 15 mol %. At mixing the organic silver salt and the light-sensitive silver salt, it is preferred for controlling the photographic characteristics to mix two or more kinds of aqueous organic silver salt dispersions and two or more kinds of aqueous light-sensitive silver salt dispersions.

The organic silver salt can be used at a desired amount, but in the case, the silver amount is preferably from 0.1 to 5 g/m$^2$, and more preferably from 1 to 3 g/m$^2$.

The photothermographic material of the invention comprises a reducing agent for silver ions. The reducing agent for silver ions may be an optional substance (preferably an organic substance) of reducing silver ions to metallic silver. Such reducing agents are described in paragraph numbers 0043 to 0045 of JP-A-11-65021 and EP-A-0803764, page 7, line 34 to page 18, line 12.

As the reducing agent used in the invention, bisphenols are preferred, and also the compounds represented by the following formula (I) are more preferred.

(I)

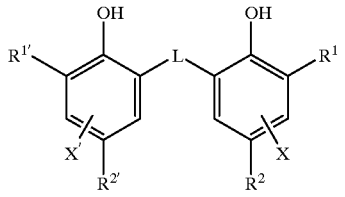

In the formula (I), $R^1$ and $R^{1'}$ each independently represents an alkyl group having from 1 to 20 carbon atoms, $R^2$ and $R^{2'}$ each independently represents a hydrogen atom, or a substituent capable of being substituted to the benzene ring, L represents an —S— group or a —CHR$^3$— group, wherein $R^3$ represents a hydrogen atom or an alkyl group having from 1 to 20 carbon atoms, and X and X' each independently represents a hydrogen atom or a substituent capable of being substituted to the benzene ring.

Then, the formula (I) is explained in detail.

In the formula, $R^1$ and $R^{1'}$ each independently represents a substituted or unsubstituted alkyl group having from 1 to 20 carbon atoms. The alkyl group may be straight chain, branched, cyclic or the combination of them. There is no particular restriction on the substituent of the alkyl group but the substituent preferably includes an aryl group, a hydroxy group, an alkoxy group, an aryloxy group, an alkylthio group, an arylthio group, an acylamino group, a sulfonamido group, a sulfonyl group, a phosphoryl group, an oxycarbonyl group, an acyl group, a carbamoyl group, a sulfamoyl group, an ester group, a halogen atom, etc.

Also, $R^2$ and $R^{2'}$ each independently represents a hydrogen atom, or a substituent capable of being substituted to the benzene ring and X and X' each also independently represents a hydrogen atom or a substituent capable of being substituted to the benzene ring. The substituent capable of being substituted to the benzene ring as used herein includes preferably an alkyl group, an aryl group, a halogen atom, an alkoxy group, and an acylamino group.

In the formula, L represents an —S— group or a —CHR$^3$— group, wherein $R^3$ represents a hydrogen atom or an alkyl group having from 1 to 20 carbon atoms. The alkyl group may be straight chain, branched, cyclic, or a combination of them. The alkyl group may have a substituent. Specific examples of the unsubstituted alkyl group represented by $R^3$ include methyl, ethyl, propyl, butyl, heptyl, undecyl, isopropyl, 1-ethylpentyl, and 2,4,4-trimethylpentyl. Examples of the substituent of the alkyl group are same as the substituents of the alkyl group represented by $R^1$ described above and include a halogen atom, an aryl group, a hydroxyl group, an alkoxy group, an alkylthio group, an aryloxy group, an arylthio group, an acylamino group, a sulfonamido group, a sulfonyl group, a phosphoryl group, an oxycarbonyl group, an acyl group, a carbamoyl group, a sulfamoyl group, and an ester group.

$R^1$ and $R^{1'}$ each is preferably a secondary or tertiary alkyl group having from 3 to 15 carbon atoms, and specifically, there are isopropyl, isobutyl, t-butyl, t-amyl, t-octyl, cyclohexyl, cyclopentyl, 1-methylcyclohexyl, 1-methylcyclopropyl, etc. $R^1$ and $R^{1'}$ are more preferably tertiary alkyl groups having from 4 to 12 carbon atoms, and in these groups, t-butyl, t-amyl, and 1-methylcyclohexyl are still more preferred, and t-butyl is most preferred.

$R^2$ and $R^{2'}$ are preferably alkyl groups having from 1 to 20 carbon atoms and specific examples thereof include methyl, ethyl, propyl, butyl, isopropyl, t-butyl, t-amyl, cyclohexyl, 1-methylcyclohexyl, benzyl, methoxymethyl, and methoxyethyl. More preferably, there are methyl, ethyl, propyl, isopropyl, and t-butyl.

X and X' each is preferably a hydrogen atom, a halogen atom, and an alkyl group, and more preferably a hydrogen atom.

L is preferably a —$CHR^3$— group.

$R^3$ is preferably a hydrogen atom or an alkyl group having from 1 to 15 carbon atoms and preferred examples of the alkyl group include methyl, ethyl, propyl, isopropyl, and 2,4,4-trimethylpentyl. $R^3$ is particularly preferably a hydrogen atom, methyl, ethyl, and propyl.

When $R^3$ is a hydrogen atom, $R^2$ and $R^{2'}$ are preferably alkyl groups having from 2 to 5 carbon atoms, and ethyl and propyl are more preferred, and ethyl is most preferred.

When $R^3$ is a primary or secondary alkyl group having from 1 to 8 carbon atoms, $R^2$ and $R^{2'}$ each is preferably methyl. As the primary or secondary alkyl group having from 1 to 8 carbon atoms represented by $R^3$, methyl, ethyl, propyl, and isopropyl are more preferred, and methyl, ethyl, and propyl are still more preferred.

Then, the specific examples of the compound represented by the formula (I), which are preferably used in the invention, are shown below, but the invention is not limited to them.

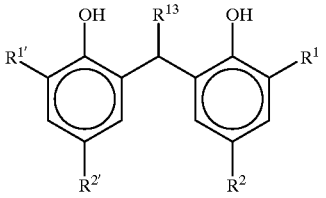

| | $R^1$ | $R^{1'}$ | $R^2$ | $R^{2'}$ | $R^{13}$ |
|---|---|---|---|---|---|
| 1 | $CH_3$ | $CH_3$ | $CH_3$ | $CH_3$ | H |
| 2 | $CH_3$ | $CH_3$ | $CH_3$ | $CH_3$ | $CH_3$ |
| 3 | $CH_3$ | $CH_3$ | $CH_3$ | $CH_3$ | $C_3H_7$ |
| 4 | $CH_3$ | $CH_3$ | $CH_3$ | $CH_3$ | i-$C_3H_7$ |
| 5 | $CH_3$ | $CH_3$ | $CH_3$ | $CH_3$ | $CH(C_2H_5)C_4H_9$ |
| 6 | $CH_3$ | $CH_3$ | $CH_3$ | $CH_3$ | $CH_2CH(CH_3)CH_2C(CH_3)_3$ |
| 7 | $CH_3$ | $CH_3$ | $C_2H_5$ | $C_2H_5$ | H |
| 8 | $CH_3$ | $CH_3$ | $C_2H_5$ | $C_2H_5$ | i-$C_3H_7$ |
| 9 | $C_2H_5$ | $C_2H_5$ | $CH_3$ | $CH_3$ | H |
| 10 | $C_2H_5$ | $C_2H_5$ | $CH_3$ | $CH_3$ | i-$C_3H_7$ |
| 11 | t-$C_4H_9$ | t-$C_4H_9$ | $CH_3$ | $CH_3$ | H |
| 12 | t-$C_4H_9$ | t-$C_4H_9$ | $CH_3$ | $CH_3$ | $CH_3$ |
| 13 | t-$C_4H_9$ | t-$C_4H_9$ | $CH_3$ | $CH_3$ | $C_2H_5$ |
| 14 | t-$C_4H_9$ | t-$C_4H_9$ | $CH_3$ | $CH_3$ | n-$C_3H_7$ |
| 15 | t-$C_4H_9$ | t-$C_4H_9$ | $CH_3$ | $CH_3$ | n-$C_4H_9$ |
| 16 | t-$C_4H_9$ | t-$C_4H_9$ | $CH_3$ | $CH_3$ | n-$C_7H_{15}$ |
| 17 | t-$C_4H_9$ | t-$C_4H_9$ | $CH_3$ | $CH_3$ | n-$C_{11}H_{21}$ |
| 18 | t-$C_4H_9$ | t-$C_4H_9$ | $CH_3$ | $CH_3$ | i-$C_3H_7$ |
| 19 | t-$C_4H_9$ | t-$C_4H_9$ | $CH_3$ | $CH_3$ | $CH(C_2H_5)C_4H_9$ |
| 20 | t-$C_4H_9$ | t-$C_4H_9$ | $CH_3$ | $CH_3$ | $CH_2CH(CH_3)_2$ |
| 21 | t-$C_4H_9$ | t-$C_4H_9$ | $CH_3$ | $CH_3$ | $CH_2CH(CH_3)CH_2C(CH_3)_3$ |
| 22 | t-$C_4H_9$ | t-$C_4H_9$ | $CH_3$ | $CH_3$ | $CH_2OCH_3$ |
| 23 | t-$C_4H_9$ | t-$C_4H_9$ | $CH_3$ | $CH_3$ | $CH_2CH_2OCH_3$ |
| 24 | t-$C_4H_9$ | t-$C_4H_9$ | $CH_3$ | $CH_3$ | $CH_2CH_2OC_4H_9$ |
| 25 | t-$C_4H_9$ | t-$C_4H_9$ | $CH_3$ | $CH_3$ | $CH_2CH_2SC_{12}H_{25}$ |
| 26 | t-$C_4H_9$ | t-$C_4H_9$ | $C_2H_5$ | $C_2H_5$ | H |
| 27 | t-$C_4H_9$ | t-$C_4H_9$ | $C_2H_5$ | $C_2H_5$ | $CH_3$ |
| 28 | t-$C_4H_9$ | t-$C_4H_9$ | $C_2H_5$ | $C_2H_5$ | n-$C_3H_7$ |
| 29 | t-$C_4H_9$ | t-$C_4H_9$ | $C_2H_5$ | $C_2H_5$ | i-$C_3H_7$ |
| 30 | t-$C_4H_9$ | t-$C_4H_9$ | $C_2H_5$ | $C_2H_5$ | $CH_2CH_2OCH_3$ |
| 31 | t-$C_4H_9$ | t-$C_4H_9$ | n-$C_3H_7$ | n-$C_3H_7$ | H |
| 32 | t-$C_4H_9$ | t-$C_4H_9$ | n-$C_3H_7$ | n-$C_3H_7$ | $CH_3$ |
| 33 | t-$C_4H_9$ | t-$C_4H_9$ | n-$C_3H_7$ | n-$C_3H_7$ | n-$C_3H_7$ |
| 34 | t-$C_4H_9$ | t-$C_4H_9$ | n-$C_4H_9$ | n-$C_4H_9$ | H |
| 35 | t-$C_4H_9$ | t-$C_4H_9$ | n-$C_4H_9$ | n-$C_4H_9$ | $CH_3$ |

-continued

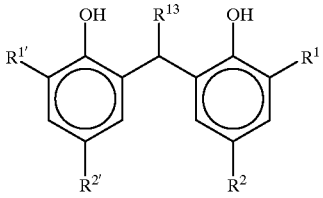

| | $R^1$ | $R^{1'}$ | $R^2$ | $R^{2'}$ | $R^{13}$ |
|---|---|---|---|---|---|
| 36 | t-$C_5H_{11}$ | t-$C_5H_{11}$ | $CH_3$ | $CH_3$ | H |
| 37 | t-$C_5H_{11}$ | t-$C_5H_{11}$ | $CH_3$ | $CH_3$ | $CH_3$ |
| 38 | t-$C_5H_{11}$ | t-$C_5H_{11}$ | $C_2H_5$ | $C_2H_5$ | H |
| 39 | t-$C_5H_{11}$ | t-$C_5H_{11}$ | $C_2H_5$ | $C_2H_5$ | $CH_3$ |
| 40 | i-$C_3H_7$ | i-$C_3H_7$ | $CH_3$ | $CH_3$ | H |
| 41 | i-$C_3H_7$ | i-$C_3H_7$ | $CH_3$ | $CH_3$ | n-$C_3H_7$ |
| 42 | i-$C_3H_7$ | i-$C_3H_7$ | $C_2H_5$ | $C_2H_5$ | H |
| 43 | i-$C_3H_7$ | i-$C_3H_7$ | $C_2H_5$ | $C_2H_5$ | n-$C_3H_7$ |
| 44 | i-$C_3H_7$ | i-$C_3H_7$ | i-$C_3H_7$ | i-$C_3H_7$ | H |
| 45 | i-$C_3H_7$ | i-$C_3H_7$ | i-$C_3H_7$ | i-$C_3H_7$ | $CH_3$ |
| 46 | t-$C_4H_9$ | $CH_3$ | $CH_3$ | $CH_3$ | H |
| 47 | t-$C_4H_9$ | $CH_3$ | $CH_3$ | $CH_3$ | $CH_3$ |
| 48 | t-$C_4H_9$ | $CH_3$ | $CH_3$ | $CH_3$ | n-$C_3H_7$ |
| 49 | t-$C_4H_9$ | $CH_3$ | t-$C_4H_9$ | $CH_3$ | $CH_3$ |
| 50 | i-$C_3H_7$ | $CH_3$ | $CH_3$ | $CH_3$ | $CH_3$ |

51

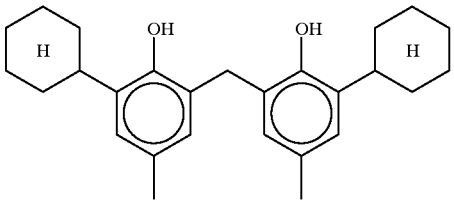

52

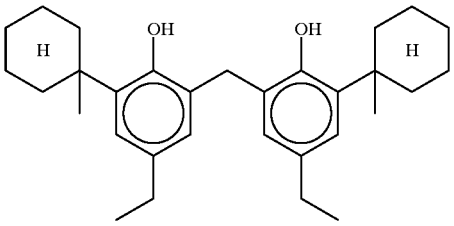

53

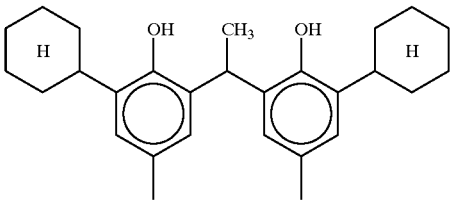

54

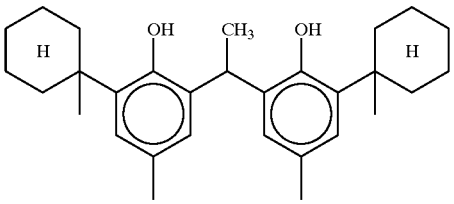

-continued
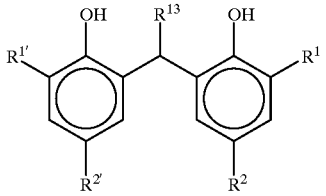
| | $R^1$ | $R^{1'}$ | $R^2$ | $R^{2'}$ | $R^{13}$ |
|---|---|---|---|---|---|
| 55 | 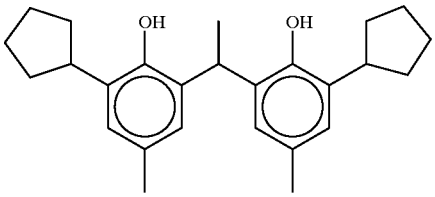 | | | | |
| 56 | 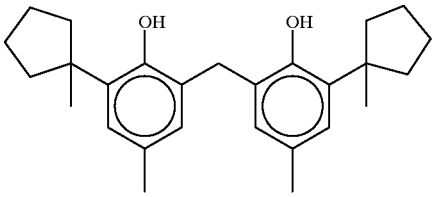 | | | | |
| 57 | 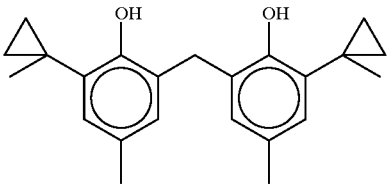 | | | | |
| 58 | 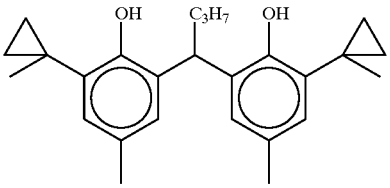 | | | | |
| 59 | 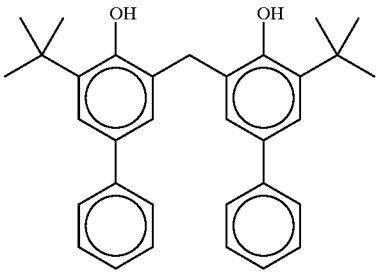 | | | | |
| 60 | 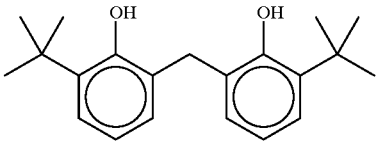 | | | | |
-continued
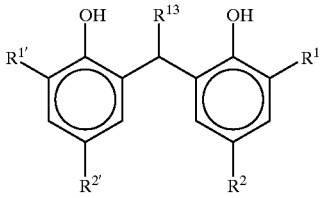
| | $R^1$ | $R^{1'}$ | $R^2$ | $R^{2'}$ | $R^{13}$ |
|---|---|---|---|---|---|
| 61 | 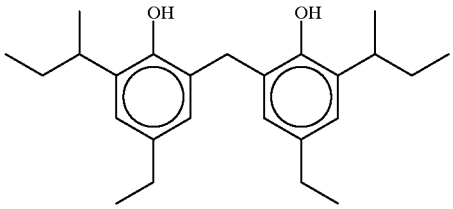 | | | | |
| 62 | 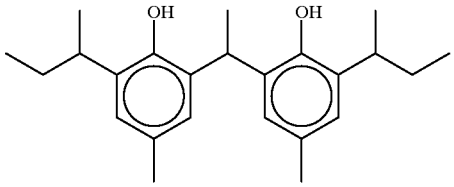 | | | | |
| 63 | 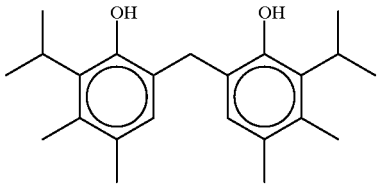 | | | | |
| 64 | 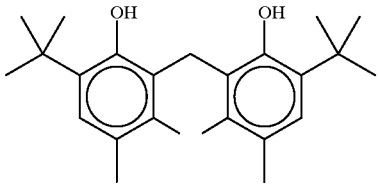 | | | | |
| 65 | 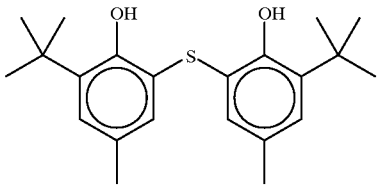 | | | | |
| 66 | 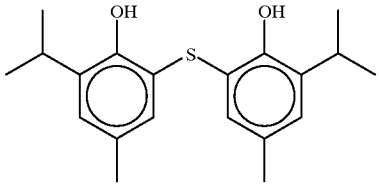 | | | | |

-continued

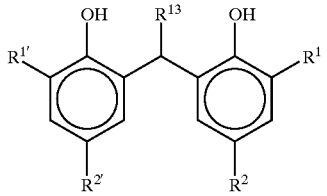

| | $R^1$ | $R^{1'}$ | $R^2$ | $R^{2'}$ | $R^{13}$ |
|---|---|---|---|---|---|
| 67 | 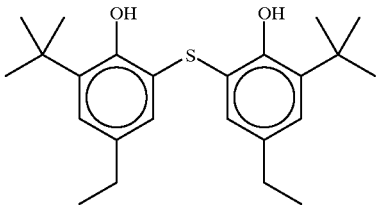 | | | | |
| 68 | 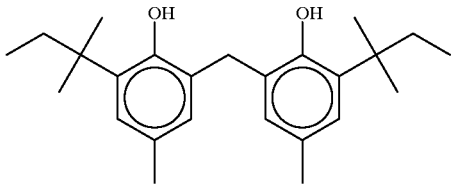 | | | | |
| 69 | 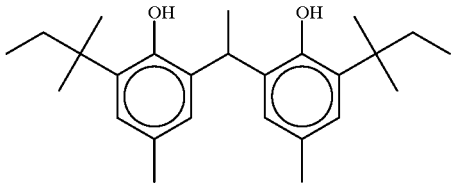 | | | | |
| 70 | 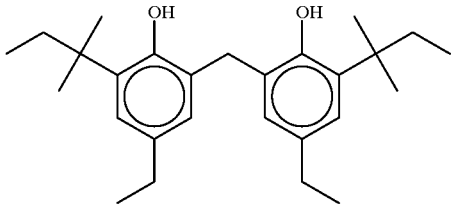 | | | | |
| 71 | 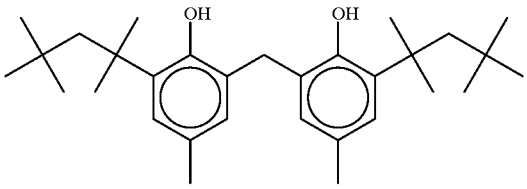 | | | | |
| 72 | 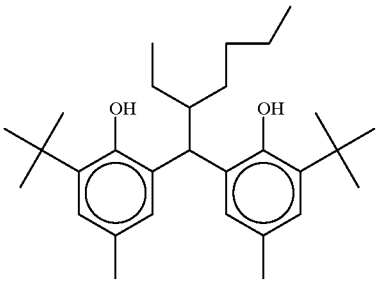 | | | | |

-continued

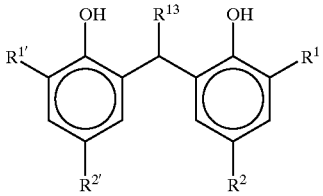

| | $R^1$ | $R^{1'}$ | $R^2$ | $R^{2'}$ | $R^{13}$ |
|---|---|---|---|---|---|
| 73 | 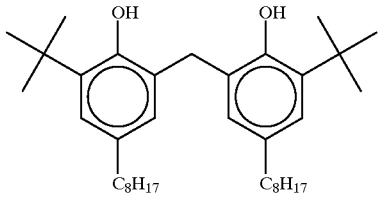 | | | | |
| 74 | 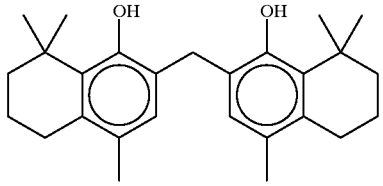 | | | | |
| 75 | 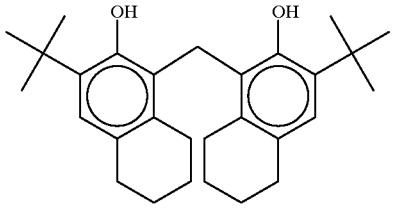 | | | | |
| 76 | 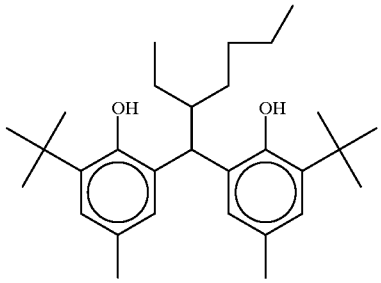 | | | | |

In the invention, the amount of the reducing agent added is preferably from 0.01 to 5.0 g/m$^2$, and more preferably from 0.1 to 3.0 g/m$^2$, and also, the reducing agent is contained in an amount of preferably from 5 to 50 mol %, and more preferably from 10 to 40 mol % per mol of silver on the side of support on which side the image-forming layer is provided. It is preferred that the reducing agent is incorporated in the image-forming layer.

The reducing agent may be incorporated in a coating solution in any form such as a solution form, an emulsified dispersion form, a solid fine particle dispersion form, etc., and contained in the light-sensitive material.

As a well-known emulsion-dispersing method, there is a method of dissolving the reducing agent using an oil such as dibutyl phthalate, tricresyl phosphate, glyceryl triacetate, diethyl phthalate, etc., and an auxiliary solvent such as ethyl acetate, cyclohexanone, etc., and mechanically preparing the emulsified dispersion.

Also, as a solid fine particle dispersing method, there is a method of preparing a solid dispersion by dispersing the powder of the reducing agent in a proper solvent such as water by a ball mill, a colloid mill, a vibration mill, a sand mill, a jet mill, a roller mill, or ultrasonic waves.

In addition, in this case, a protective colloid (for example, polyvinyl alcohol) or a surface active agent (for example, an anionic surface agent such as sodium triisopropylnaphthalenesulfonate (a mixture of compounds each being different in substitution position of three isopropyl groups)) may be used. The aqueous dispersion can contain an antiseptic (for example, a benzoisothiazolinone sodium salt).

For the photothermographic material of the invention, the phenol derivatives represented by the formula (A) described in Japanese Patent Application No. Hei. 11-73951 are preferably used.

When the reducing agent used in the invention has an aromatic hydroxy group (—OH), in particular, when the reducing agent is a bisphenol as described above, it is preferred use together a non-reducing agent having a group capable of forming a hydrogen bond with the group. As the group forming a hydrogen bond with a hydroxy group or an amino group, there are a phosphoryl group, a sulfoxido group, a sulfonyl group, a carbonyl group, an amido group, an ester group, a urethane group, an ureido group, a tertiary amino group, a nitrogen-containing aromatic group. etc. In these compounds, the compounds having a phosphoryl group, a sulfoxido group, an amido group (however, does not have a >N—H group and is blocked as >N—R, wherein R is a substituent other than H), a urethane group (however, does not have a >N—H group and is blocked as >N—R, wherein R is a substituent other than H), or a ureido group (however, does not have a >N—H group and is blocked as >N—R, wherein R is a substituent other than H) are preferred.

The particularly preferred hydrogen-bonding compounds are the compounds represented by the following formula (II);

(II)

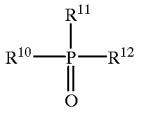

In the formula (II), $R^{10}$, $R^{11}$, and $R^{12}$ each independently represents an alkyl group, an aryl group, an aralkyl group, an alkoxy group, an aryloxy group, an amino group, or a heterocyclic group, and these groups may be unsubstituted or may have substituents. The substituent, when $R^{10}$, $R^{11}$, and $R^{12}$ each has a substituent, includes a halogen atom, an alkyl group, an aryl group, an alkoxy group, an amino group, an acyl group, an acylamino group, an alkylthio group, an arylthio group, a sulfonamido group, an acyloxy group, an oxycarbonyl group, a carbamoyl group, a sulfamoyl group, a sulfonyl group, a phosphoryl group, etc., and the preferred substituents are an alkyl group or an aryl group, such as, for example, methyl, ethyl, isopropyl, t-butyl, t-octyl, phenyl, 4-alkoxyphenyl, and 4-acyloxyphenyl.

As the alkyl groups represented by $R^{10}$ to $R^{12}$, the straight chain, branched, cyclic, or combined thereof, substituted or unsubstituted alkyl groups having from 1 to 20 carbon atoms are preferred, and specifically, there are methyl, ethyl, butyl, octyl, dodecyl, isopropyl, t-butyl, t-amyl, t-octyl, cyclohexyl, 1-methylcyclohexyl, benzyl, phenetyl, 2-phenoxypropyl, etc.

Examples of the aralkyl group, the aralkyl groups having from 7 to 27 carbon atoms are preferred, and there are benzyl, phenetyl, 2-phenoxypropyl, etc.

As the aryl groups, the monocyclic or polycyclic substituted or unsubstituted aryl groups having from 6 to 20 carbon atoms are preferred, and there are phenyl, cresyl, xylyl, naphthyl, 4-t-butylphenyl, 4-t-octylphenyl, 4-anisidyl, 3,5-dichlorophenyl, etc.

As the alkoxy groups, the straight chain, branched, cyclic, or combined thereof, substituted or unsubstituted alkoxy groups having from 1 to 20 carbon atoms are preferred, and there are methoxy, ethoxy, butoxy, octyloxy, 2-ethylhexyloxy, 3,5,5-trimethylhexyloxy, dodecyloxy, cyclohexyloxy, 4-methylcyclohexyloxy, benzyloxy, etc.

As the aryloxy groups, the aryloxy groups having from 6 to 20 carbon atoms are preferred, and there are phenoxy, cresyloxy, isoprpylphenoxy, 4-t-butylphenoxy, naphthoxy, biphenyloxy, etc.

As the amino groups, the amino groups having from 0 to 20 carbon atoms are preferred, and there are dimethylamino, diethylaino, dibutylamino, dioctylamino, N-methyl-N-hexylamino, dicyclohexylamino, diphenylamino, N-methyl-N-phenylamino, etc.

The heterocyclic groups are three-membered to ten-membered saturated or unsaturated heterocyclic groups containing at least one of an N atom, an O atom, and an S atoms, and further, the heterocyclic group may form a condensed ring with other ring. Specific examples of the hetero ring in the heterocyclic group include pyrrolidine, piperidine, piperazine, morpholine, thiophene, furan, pyrrole, imidazole, pyrazole, pyridine, pyrimidine, pyrazine, pyridazine, triazole, triazine, indole, indazole, purine, thiadiazole, oxadiazole, quinoline, phthalazine, naphthyridine, quinoxaline, quinazoline, cinnoline, pteridine, acridine, phenanthroline, phenazine, tetrazole, thiazole, oxazole, benzimidazole, benzoxazole, benzthiazole, benzoselenazole, indolenine, tetrazaindene, etc.

$R^{10}$ and $R^{11}$; $R^{11}$ and $R^{12}$; or $R^{10}$, $R^{11}$ and $R^{12}$ can join together to form a monocyclic or polycyclic hydrocarbon group which may be substituted.

As $R^{10}$ to $R^{12}$, an alkyl group, an aryl group, an alkoxy group, and an aryloxy group are preferred. From the point of the effects of the invention, it is preferred that at least one of $R^{10}$ to $R^{12}$ is an alkyl group or an aryl group and it is more preferred that at least two of them are alkyl group or an aryl group. Also, from the point of available at a low cost, the case that $R^{10}$ to $R^{12}$ are a same group.

Then, specific examples of the compound represented by the formula (II), which can be used in the invention, are shown below, but the invention is not limited to them.

(II-1)

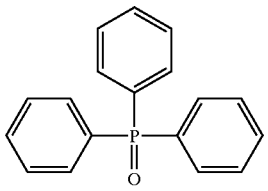

-continued
(II-2)
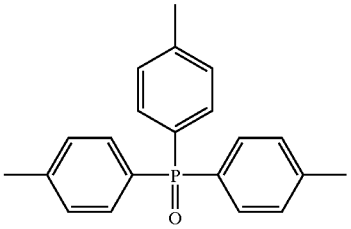
(II-3)
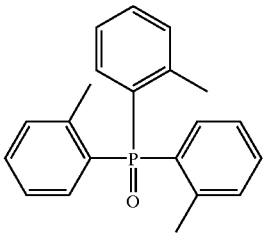
(II-4)
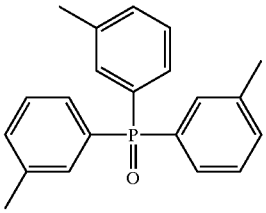
(II-5)
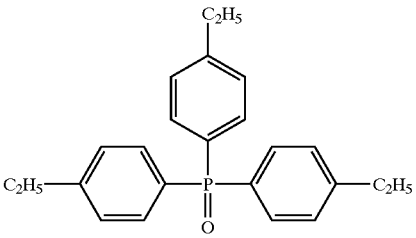
(II-6)
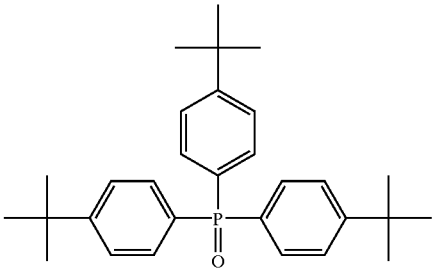
(II-7)
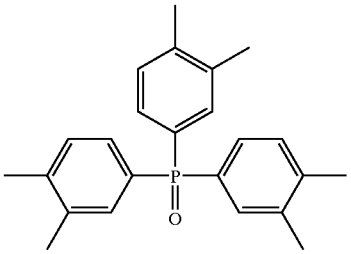
-continued
(II-8)
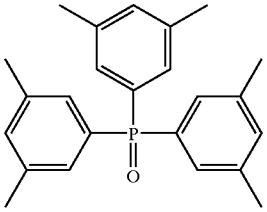
(II-9)
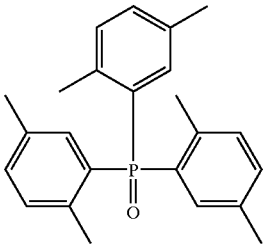
(II-10)
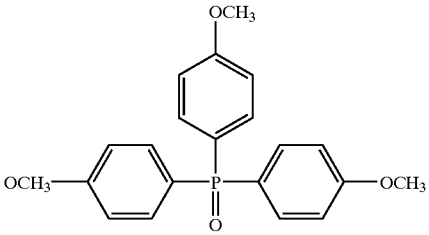
(II-11)
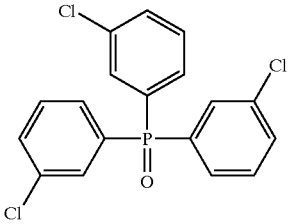
(II-12)
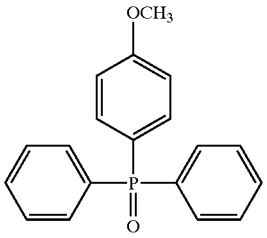
(II-13)
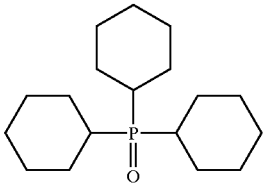
(II-14)
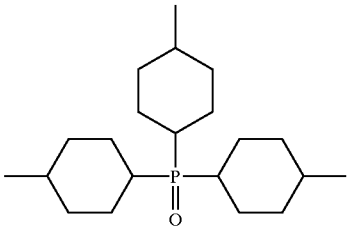

-continued
(II-15)
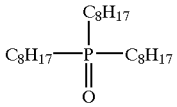
(II-16)
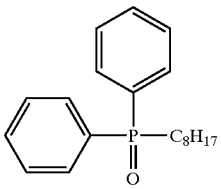
(II-17)
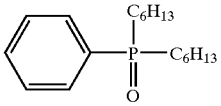
(II-18)
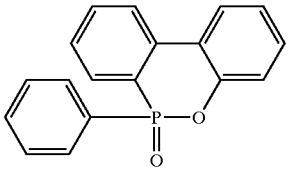
(II-19)
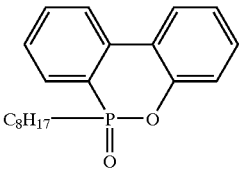
(II-20)
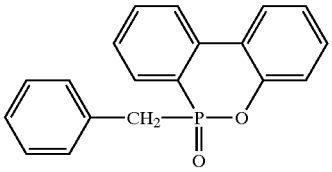
(II-21)
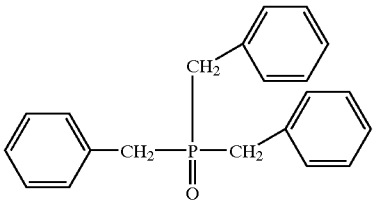
(II-22)
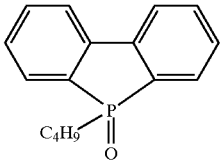
(II-23)
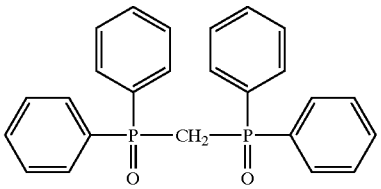
-continued
(II-24)
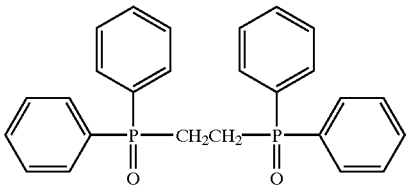
(II-25)
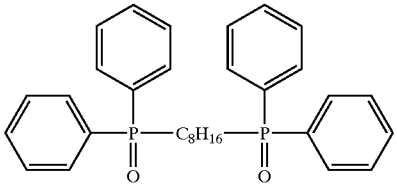
(II-26)
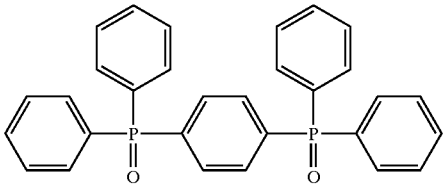
(II-27)
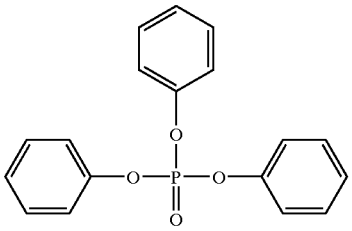
(II-28)
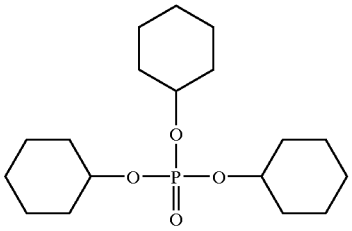
(II-29)
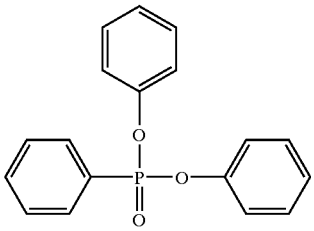
(II-30)
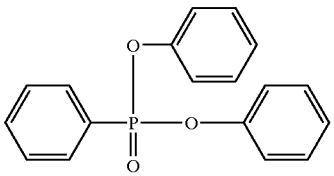

-continued (II-31)

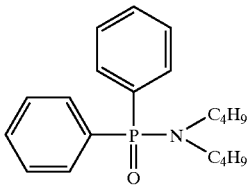

(II-32)

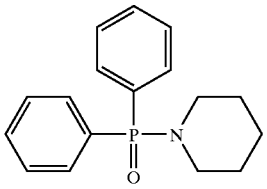

(II-33)

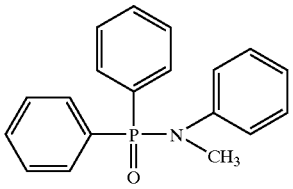

(II-34)

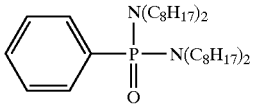

(II-35)

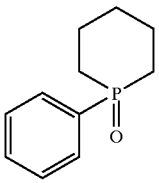

(II-36)

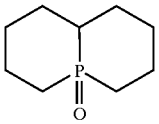

(II-37)

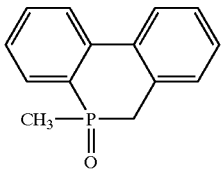

(II-38)

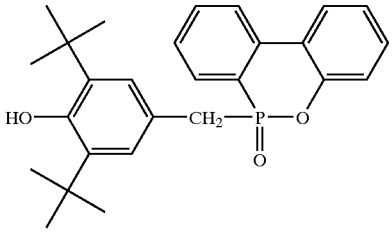

-continued (II-39)

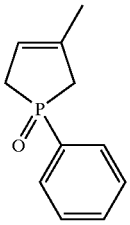

(II-40)

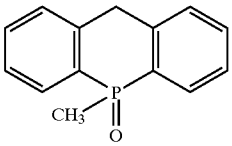

The compound of the formula (II) can be used in the light-sensitive material of the invention by incorporated in the coating solution in a solution form, an emulsified dispersion form, or a solid fine particle dispersion form as the above-described case of the reducing agent.

The compound of the formula (II) forms a hydrogen bonding complex with a compound having a phenolic hydroxy group and an amino group in a solution state, and according to the kind of the combination of the reducing agent and the compound of the formula (II), the product can be isolated in a crystal state as a complex. It is particularly preferred for the point of obtaining a stabilized performance to use the crystal powder isolated as described above as the solid fine particle dispersion. Also, a method of mixing the reducing agent and the compound of the formula (II) as a state of powders, and forming the complex at dispersing using a proper dispersing agent by a sand grinder mill, etc., can be preferably used.

The compound of the formula (II) is used in the range of preferably from 1 to 200 mol %, more preferably from 10 to 150 mol %, and still more preferably from 30 to 100 mol % to the reducing agent.

The photothermographic material of the invention comprises a light-sensitive silver halide. There is no particular limitation on the composition of the light-sensitive silver halides used in the invention, and silver chloride, silver chlorobromide, silver bromide, silver iodobromide and silver iodochlorobromide can be used. The distribution of the halogen composition in the grain of the light-sensitive silver halide may be uniform, or the halogen composition may vary stepwise or continuously. Further, silver halide grains having the core/shell structure can be preferably used. Double to fivefold structure type core/shell grains can be preferably used, and double to fourfold structure type core/shell grains can be more preferably used. Furthermore, a technique of localizing silver bromide on the surfaces of silver chloride or silver chlorobromide grains can also preferably used.

Methods for forming the light-sensitive silver halides are well known in the art. For example, methods described in *Research Disclosure*, vol. 17029 (June, 1978) and U.S. Pat. No. 3,700,458 can be used. Specifically, a method of adding a silver supplying compound and a halogen supplying compound to a gelatin solution or another polymer solution to prepare a light-sensitive silver halide, and then, mixing the resulting silver halide with an organic silver salt is used. Methods described in JP-A-11-119374, paragraph numbers 0217 to 0224, Japanese Patent Application Nos. Hei. 11-98708 and Hei. 11-84182 are also preferred.

For inhibiting white turbidity after image formation, it is preferred that the grain size of the light-sensitive silver halide is small. Specifically, the grain size is preferably 0.20 μm or less, more preferably from 0.01 to 0.15 μm, and still more preferably from 0.02 to 0.12 μm. The term "grain size" as used herein means the diameter of a circle image to which a projected area (in the case of a tabular grain, a projected area of a main surface) of the silver halide grain is converted, the circle image having the same area as the projected area.

The form of the silver halide grains may be cubic, octahedral, tabular, spherical, rod-like or pebble-like. In the invention, however, cubic grains are particularly preferred. Silver halide grains having rounded corners can also be preferably used. There is no particular limitation on the surface index (mirror index) of outer surfaces of the light-sensitive silver halide grains. However, it is preferred that the ratio of the {100} face is high, the {100} face having high spectral sensitization efficiency when a spectral sensitizing dye is adsorbed thereby. The ratio is preferably 50% or more, more preferably 65% or more, and most preferably 80% or more. The ratio of the mirror index {100} face can be determined by a method described in T. Tani, *Imaging Sci.*, 29, 165 (1985), utilizing adsorption dependency of the {111} face and the {100} face in adsorption of a sensitizing dye.

In the invention, silver halide grains in which a hexacyano metal complex is allowed to exist on uppermost surfaces of the grains are preferred. The hexacyano metal complexes include $[Fe(CN)_6]^{4-}$, $[Fe(CN)_6]^{3-}$, $[Ru(CN)_6]^{4-}$, $[Os(CN)_6]^{4-}$, $[Co(CN)_6]^{3-}$, $[Rh(CN)_6]^{3-}$, $[Ir(CN)_6]^{3-}$, $[Cr(CN)_6]^{3-}$ and $[Re(CN)_6]^{3-}$. In the invention, hexacyano Fe complexes are preferred.

Counter cations are not important, because the hexacyano metal complexes exist in the form of ions in aqueous solutions. However, alkali metal ions such as sodium ions, potassium ions, rubidium ions, cesium ions and lithium ions, ammonium ions, and alkylammonium ions (e.g., tetramethylammonium ions, tetraethylammonium ions, tetrapropylammonium ions, tetra(n-butyl)ammonium ions), which are easily miscible with water and compatible for precipitation operations of silver halide emulsions, are preferably used as the counter cations.

The hexacyano metal complexes can be added as mixtures thereof with mixed solvents of water and proper water-miscible organic solvents (e.g., alcohols, ethers, glycols, ketones, esters and amides) or gelatin, as well as water.

The amount of the hexacyano metal complex added is preferably from $1\times10^{-5}$ to $1\times10^{-2}$ mol, and more preferably from $1\times10^{-4}$ to $1\times10^{-3}$ mol.

For allowing the hexacyano metal complex to exist on the uppermost surfaces of the silver halide grains, the hexacyano metal complex is directly added after the termination of the addition of an aqueous solution of silver nitrate used for grain formation, before the termination of charging until before chemical sensitization in which chalcogen sensitization such as sulfur sensitization, selenium sensitization and tellurium sensitization, or noble metal sensitization such as gold sensitization is conducted, during washing, during dispersion or before chemical sensitization. In order to prevent the silver halide grains from growing, it is preferred that the hexacyano metal complex is added immediately after grain formation, and before the termination of charging.

The addition of the hexacyano metal complex may be initiated after 96% by weight of the total amount of silver nitrate added for grain formation has been added, preferably after the addition of 98% by weight, and particularly preferably after the addition of 99% by weight.

When the hexacyano metal complex is added after the addition of the aqueous solution of silver nitrate immediately before the completion of grain formation, the complex can be adsorbed by the uppermost surfaces of the silver halide grains, and almost forms a slightly soluble salt with silver ions on the grain surfaces. The silver salt of hexacyanoferric (II) acid is a salt more slightly soluble than AgI, so that redissolution caused by fine grains can be prevented, which makes it possible to produce fine silver halide grains having small grain size.

The light-sensitive silver halide grains used in the invention can contain metals of groups 8 to 10 in the periodic table (showing groups 1 to 18) or metal complexes. The metals of groups 8 to 10 in the periodic table or central metals of the metal complexes are preferably rhodium, ruthenium and iridium. These metal complexes may be used either alone or as a combination of two or more of complexes comprising the same kind or different kinds of metals. The content thereof is preferably from $1\times10^{-9}$ to $1\times10^{-3}$ mol per mol of silver. These metals, metal complexes and methods for adding them are described in JP-A-7-225449, JP-A-11-65021, paragraph numbers 0018 to 0024, and JP-A-11-119374, paragraph numbers 0227 to 0240.

Further, metal atoms which can be contained in the silver halide grains used in the invention (e.g., $[Fe(CN)_6]^{4-}$), desalting methods and chemical sensitizing methods of the silver halide emulsions are described in JP-A-11-84574, paragraph numbers 0046 to 0050, JP-A-11-65021, paragraph numbers 0025 to 0031, and JP-A-11-119374, paragraph number 0242 to 0250.

Various kinds of gelatins can be used as gelatins contained in the light-sensitive silver halide emulsions used in the invention. In order to keep good the dispersing state of the light-sensitive silver halide emulsions in organic silver salt-containing coating solutions, it is preferred that low molecular weight gelatins having a molecular weight of 500 to 60,000 are used. Although these low molecular weight gelatins may be used in forming the grains, or in dispersing the grains after desalting, they are preferably used in dispersing the grains after desalting.

As sensitizing dyes applicable to the invention, there can be selected sensitizing dyes which can spectrally sensitize the silver halide grains in a desired wavelength region when adsorbed by the silver halide grains, and which have spectral sensitivity suitable for the spectral characteristics of an exposure light source. The sensitizing dyes and methods for adding them are described in JP-A-11-65021, paragraph numbers 0103 to 0109, JP-A-10-186572 (compounds represented by formula (II)), JP-A-11-119374 (dyes represented by formula (I) and paragraph number 0106), U.S. Pat. Nos. 5,510,236 and 3,871,887 (dyes described in Example 5), JP-A-2-96131, JP-A-59-48753 (dyes described therein), EP-A-0803764, page 19, line 38 to page 20, line 35, and Japanese Patent Application Nos. 2000-86865 and 2000-102560. These sensitizing dyes may be used either alone or as a combination of two or more of them. In the invention, the sensitizing dyes are added to the silver halide emulsions preferably from after desalting to coating, and more preferably from after desalting to before the start of chemical ripening.

In the invention, the sensitizing dyes may be used in a desired amount depending on performances such as sensitivity and fog. However, they are used preferably in an amount of $10^{-6}$ to 1 mol, and more preferably in an amount of $10^{-4}$ to $10^{-1}$ mol, per mol of silver halide of the light-sensitive layer.

In the invention, for improving spectral sensitization efficiency, supersensitizing agents can be used. The supersensitizing agents used in the invention include compounds described in EP-A-587,338, U.S. Pat. Nos. 3,877,943 and 4,873,184, JP-A-5-341432, JP-A-11-109547 and JP-A-10-111543.

It is preferred that the light-sensitive silver halide grains used in the invention are chemically sensitized by sulfur sensitization, selenium sensitization or tellurium sensitization. As compounds preferably used for sulfur sensitization, selenium sensitization and tellurium sensitization, there can be used known compounds, for example, compounds described in JP-A-7-128768. In particular, tellurium sensitization is preferably used in the invention, and more preferred are compounds described in the literatures described in JP-A-11-65021, paragraph number 0030, and compounds represented by formulas (II), (III) and (IV) in JP-A-5-313284.

In the invention, chemical sensitization is possible at any time, such as (1) before spectral sensitization, (2) concurrently with spectral sensitization, (3) after spectral sensitization or (4) immediately before coating, after desalting, as long as it is conducted after grain formation and before coating. In particular, chemical sensitization is preferably conducted after spectral sensitization.

The amount of sulfur, selenium and tellurium sensitizers used in the invention is from $1\times10^{-8}$ to $1\times10^{-2}$ mol, and preferably from about $1\times10^{-7}$ to about $1\times10^{-3}$ mol, per mol of silver halide, although it varies depending on the silver halide grains used and the chemical ripening conditions. There is no particular limitation on the conditions of chemical sensitization in the present invention. However, the pH is from 5 to 8, the pAg is from 6 to 11, and the temperature is from about 40° C. to about 95° C.

Thiosulfonic acid compounds may be added to the silver halide emulsions used in the invention by a method shown in EP-A-293917.

The light-sensitive silver halide emulsions in the photothermographic materials used in the invention may be used either alone or as a combination of two or more of them (for example, emulsions different in mean grain size, emulsions different in halogen composition, emulsions different in crystal habit, and emulsions different in the conditions of chemical sensitization). The use of plural kinds of light-sensitive silver halides different in sensitivity allows the gradation to be controlled. Techniques relating to these are described in JP-A-57-119341, JP-A-53-106125, JP-A-47-3929, JP-A-48-55730, JP-A-46-5187, JP-A-50-73627 and JP-A-57-150841. As to the difference in sensitivity, a difference of 0.2logE or more is preferably given between the respective emulsions.

The amount of the light-sensitive silver halide added is preferably from 0.03 to 0.6 g/m$^2$, more preferably from 0.05 to 0.4 g/m$^2$, and still more preferably from 0.1 to 0.4 g/m$^2$, in terms of the amount of silver coated per m$^2$ of light-sensitive material. The amount of the light-sensitive silver halide is preferably from 0.01 mol to 0.5 mol, and more preferably from 0.02 mol to 0.3 mol, per mol of organic silver salt.

As processes for mixing the light-sensitive silver halides with the organic silver salts separately prepared and mixing conditions thereof, there are a method of mixing the separately prepared silver halide grains and organic silver salt with each other in a high-speed stirrer, a ball mill, a sand mill, a colloid mill, a vibrating mill or a homogenizer, and a method of mixing the prepared light-sensitive silver halide at any timing during preparation of the organic silver salt to prepare the organic silver salt. However, there is no particular limitation thereon, as long as the effects of the invention are sufficiently manifested. In mixing, it is a preferred method for adjustment of photographic characteristics that two or more kinds of aqueous dispersions of the organic silver salts are mixed with two or more kinds of aqueous dispersions of the light-sensitive silver salts.

The silver halides are preferably added to the coating solutions for image forming layers from 180 minutes before coating to immediately before coating, preferably from 60 minutes before coating to 10 seconds before coating. However, there is no particular limitation on the mixing process and the mixing conditions, as long as the effects of the invention are sufficiently manifested. Specific examples of the mixing processes include a mixing process using a tank designed so that the average residence time calculated from the flow rate of the solution added and the amount of the solution supplied to a coater becomes a desired time, and a process using static mixers described in N. Harnby, M. F. Edwards and A. W. Nienow, translated by Koji Takahashi, *Liquid Mixing Techniques*, chapter 8, published by Nikkan Kogyo Shinbunsha (1989).

Binders for the organic silver salt-containing layers may be any polymers, and suitable binders are transparent or translucent and generally colorless. They are natural and synthetic resins (polymers and copolymers) and other film forming media, and examples thereof include gelatin compounds, rubber compounds, poly(vinyl alcohol) compounds, hydroxyethyl cellulose compounds, cellulose acetate compounds, cellulose acetate butylate compounds, poly(vinylpyrrolidone) compounds, casein, starch, poly (acrylic acid) compounds, poly(methyl methacrylate) compounds, poly(vinyl chloride) compounds, poly (methacrylic acid) compounds, styrene-maleic anhydride copolymers, styrene-acrylonitrile copolymers, styrene-butadiene copolymers, poly(vinyl acetal) polymers (e.g., poly(vinyl formal), poly(vinyl butyral)), polyesters, polyurethanes, phenoxy resins, poly(vinylidene chloride) compounds, polyepoxides, polycarbonates, poly(vinyl acetate) compounds, polyolefins, cellulose esters and polyamides. The binders may be formed from aqueous solutions, organic solvent solutions or emulsions by coating.

In the invention, when the organic silver salt-containing layer is formed by applying a coating solution in which 30% by weight or more of a solvent is water and drying it, the binder of the organic silver salt-containing layer is preferably soluble or dispersible in an aqueous solvent (water solvent) and particularly preferably composed of a polymer latex having an equilibrium moisture content of 2% by weight or less at 25° C., 60% RH, the physical property of the coated layer is improved. The most preferred form is one prepared so as to give an ionic conductivity of 2.5 mS/cm or less, and methods for preparing such one include a method of purifying the polymer with a separation functional membrane after synthesis thereof.

The term "an aqueous solvent in which the polymer is soluble or dispersible" as used herein means water or a mixture of water and 70% by weight or less of a water-soluble or aqueous-miscible organic solvent. The aqueous-miscible organic solvents include, for example, alcohol solvents such as methyl alcohol, ethyl alcohol and propyl alcohol, cellosolve solvents such as methyl cellosolve, ethyl cellosolve and butyl cellosolve, ethyl acetate and dimethylformamide.

In the case of a system in which the polymer is not dissolved thermodynamically to exist in a so-called dispersion state, the term "aqueous solvent" is also used herein.

The term "equilibrium moisture content at 25° C., 60% RH" as used herein can be expressed using the weight $W^1$ of a polymer attaining equilibrium with moisture in the atmosphere of 25° C. and 60% RH and the weight $W^0$ of the polymer in the absolute dry condition at 25° C. as follows:

$$\text{Equilibrium Moisture Content at } 25^\circ \text{ C., } 60\% \ RH=\{(W^1-W^0)/W^0\}\times 100(\%\text{ by weight})$$

For the definition of the moisture content and the measuring method thereof, reference can be made to *Kobunshi Kogaku Koza* (Polymer Engineering Course), 14, "Test Methods of Polymer Materials" (edited by Kobunshi Gakkai, Chijin Shokan).

The equilibrium moisture content of the binder polymer used in the invention at 25° C., 60% RH is preferably 2% by weight or less, more preferably from 0.01% to 1.5% by weight, and still more preferably from 0.02% to 1% by weight.

In the invention, polymers dispersible in the aqueous solvents are particularly preferred. Examples of the dispersion states include latexes in which fine particles of water-insoluble hydrophobic polymers are dispersed, and dispersions of polymer molecules dispersed in a molecular state or forming micelles, both of which are preferred. The mean particle size of the dispersed particles is preferably from 1 nm to 50,000 nm, and more preferably from 5 nm to 1,000 nm. There is no particular limitation on the particle size distribution of the dispersed particles. The particles may be either ones having a wide particle size distribution or ones having a monodisperse particle size distribution.

In the invention, preferred examples of the polymers dispersible in the aqueous solvents include hydrophobic polymers such as acrylic polymers, polyesters, rubber compounds (e.g., SBR resins), polyurethanes, poly(vinyl chloride) compounds, poly(vinyl acetate) compounds, poly (vinylidene chloride) compounds and polyolefins. These polymers may be straight chain polymers, branched polymers or crosslinked polymers. Further, the polymers may be either so-called homopolymers in which a single monomer is polymerized, or copolymers in which two or more kinds of monomers are polymerized. The copolymers may be either random copolymers or block copolymers. The number average molecular weight of the polymer is preferably from 5,000 to 1,000,000, and more preferably from 10,000 to 200,000. Too low a molecular weight unfavorably results in insufficient mechanical strength of the emulsion layer, whereas too high a molecular weight causes poor film forming properties.

Preferred examples of the polymer latexes include the following, wherein the polymers are represented by raw material monomers, the numerals in parentheses are percentages by weight, and the molecular weight is the number average molecular weight.

P-1: Latex of -MMA(70)-EA(27)-MAA(3)-(molecular weight: 37,000);

P-2: Latex of -MMA(70)-2EHA(20)-St(5)-AA(5)-(molecular weight: 40,000);

P-3: Latex of -St(50)-Bu(47)-MAA(3)-(molecular weight: 45,000);

P-4: Latex of -St(68)-Bu(29)-AA(3)-(molecular weight: 60,000);

P-5: Latex of -St(71)-Bu(26)-AA(3)-(molecular weight: 60,000)

P-6: Latex of -St(70)-Bu(27)-IA(1)-(molecular weight: 120,000);

P-7: Latex of -St(75)-Bu(24)-AA(1)-(molecular weight: 108,000);

P-8: Latex of -St(60)-Bu(35)-DVB(3)-MAA(2)-(molecular weight: 150,000);

P-9: Latex of -St(70)-Bu(25)-DVB(2)-AA(3)-(molecular weight: 280,000);

P-10: Latex of -VC(50)-MMA(20)-EA(20)-AN(5)-AA(5)-(molecular weight: 80,000);

P-11: Latex of -VDC(85)-MMA(5)-EA(5)-MAA(5)-(molecular weight: 67,000);

P-12: Latex of -Et(90)-MMA(10)-(molecular weight: 12,000);

P-13: Latex of -St(70)-2EHA(27)-AA(3) (molecular weight: 130,000); and

P-14: Latex of -MMA(63)-EA(35)-AA(2) (molecular weight: 33,000).

Abbreviations used in the above-mentioned structures indicate the following monomers:

MMA; Methyl methacrylate, EA; Ethyl acrylate, MAA; Methacrylic acid, 2EHA; 2-Ethylhexyl acrylate, St; Styrene, Bu; Butadiene, AA; Acrylic acid, DVB; Divinylbenzene, VC; Vinyl chloride, AN; Acrylonitrile, VDC; Vinylidene chloride, Et: Ethylene and IA; Itaconic acid.

The polymers described above are commercially available, and the following polymers can be utilized. Examples of the acrylic polymers include Cevian A-4635, 46583 and 4601 (the above products are manufactured by Daicel Chemical Industries, Ltd.) and Nipol Lx 811, 814, 821, 820 and 857 (the above products are manufactured by Nippon Zeon Co., Ltd.), examples of the polyesters include FINETEX ES 650, 611, 675 and 850 (the above products are manufactured by Dainippon Ink & Chemicals, Inc.), and WD-size and WMS (the above products are manufactured by Eastman Chemical Co.), examples of the polyurethanes include HYDRAN AP 10, 20, 30 and 40 (the above products are manufactured by Dainippon Ink & Chemicals, Inc.), examples of the rubber compounds include LACSTAR 7310K, 3307B, 4700H and 7132C (the above products are manufactured by Dainippon Ink & Chemicals, Inc.) and Nipol Lx 416, 410, 438C and 2507 (the above products are manufactured by Nippon Zeon Co., Ltd.), examples of the poly(vinyl chloride) compounds include G351 and G576 (the above products are manufactured by Nippon Zeon Co., Ltd.), examples of the poly(vinylidene chloride) compounds include L502 and L513 (the above products are manufactured by Asahi Chemical Industry Co., Ltd.), and examples of the polyolefins include Chemipearl S120 and SA100 (the above products are manufactured by Mitsui Petrochemical Industries, Ltd.).

These polymer latexes may be used either alone or as a mixture of two or more of them as required.

As the polymer latexes used in the invention, styrene-butadiene copolymer latexes are particularly preferred. In the styrene-butadiene copolymer latex, the weight ratio of styrene monomer units to butadiene monomer units is preferably from 40:60 to 95:5. Further, the ratio of the styrene monomer units and the butadiene monomer units to the copolymer is preferably from 60% to 99% by weight. The preferred molecular weight range is the same as described above.

The styrene-butadiene copolymer latexes which can be preferably used in the invention include P-3 to P-8 described above and commercially available LACSTAR-3307B, 7132C and Nipol Lx416.

The glass transition temperature (Tg) of the latex used in the invention is preferably from 10 to 80° C., and more preferably from 20 to 60° C. When a blend of two or more kinds of latexes different in Tg are used, it is preferred that the weight average Tg thereof is within the above-mentioned range.

The organic silver salt-containing layer of the photothermographic material of the invention may further contain a hydrophilic polymer such as gelatin, polyvinyl alcohol, methyl cellulose, hydroxypropyl cellulose or carboxymethyl cellulose. The amount of the hydrophilic polymer added is preferably 30% by weight or less, and more preferably 20% by weight or less, based on the total binder of the organic silver salt-containing layer.

The organic silver salt-containing layer (that is to say, the image forming layer) of the invention is preferably formed using the polymer latex, and for the amount of binder contained in the organic silver salt-containing layer, the weight ratio of total binder/organic silver salt is preferably from 1/10 to 10/1, and more preferably from 1/5 to 4/1.

Further, such an organic silver salt-containing layer is also usually a light-sensitive layer (emulsion layer) containing the light-sensitive silver halide that is the light-sensitive silver salt. In such a case, the weight ratio of total binder/silver halide is preferably from 400 to 5, and more preferably from 200 to 10.

The total binder amount of the image forming layer is preferably from 0.2 to 30 g/m$^2$, and more preferably from 1 to 15 g/m$^2$. The image forming layer may contain a crosslinking agent for crosslinking and a surfactant for improving coating properties.

The solvent (both the solvent and the dispersing medium are referred to as the solvent herein for brevity) for a coating solution for the organic silver salt-containing layer in the photothermographic material of the invention is preferably an aqueous solvent containing water in an amount of 30% by weight or more. As components other than water, any water-miscible organic solvents such as methyl alcohol, ethyl alcohol, isopropyl alcohol, methyl cellosolve, ethyl cellosolve, dimethylformamide and ethyl acetate may be used. The water content of the solvent of the coating solution is preferably 50% by weight or more, and more preferably 70% by weight or more. Preferred examples of solvent compositions include water/methyl alcohol=90/10, water/methyl alcohol=70/30, water/methyl alcohol/dimethylformamide=80/15/5, water/methyl alcohol/ethyl cellosolve=85/10/5 and water/methyl alcohol/isopropyl alcohol=85/10/5 (wherein the numeral values are percentages by weight), as well as water.

Antifoggants, stabilizers and stabilizer precursors which can be used in the invention include ones disclosed in JP-A-10-62899, paragraph number 0070 and EP-A-0803764, page 20, line 57 to page 21, line 7. Further, antifoggants preferably used in the invention are organic halides, which include ones disclosed in patents disclosed in JP-A-11-65021, paragraph numbers 0111 to 0112. In particular, organic halogen compounds represented by formula (P) of Japanese Patent Application No. Hei. 11-87297 and organic polyhalogen compounds represented by formula (II) of JP-A-10-339934 are preferred.

The organic polyhalogen compounds preferably used in the invention are described below in detail.

The polyhalogen compounds preferably used in the invention include compounds represented by the following formula (III).

$$Q—(Y)_n—C(Z^1)(Z^2)X \quad \text{(III)}$$

wherein Q represents an alkyl group, an aryl group or a heterocyclic group; Y represents a divalent connecting group; n represents 0 or 1; $Z^1$ and $Z^2$ each represents a halogen atom; and X represents a hydrogen atom or an electron attractive group.

In formula (III), the alkyl group, aryl group or heterocyclic group represented by Q may have a substituent other than $—(Y)_n—C(Z^1)(Z^2)X$ and the substituent may be selected from substituents generally known. Q preferably represents a phenyl group substituted by an electron attractive group whose Hammett σp constant is positive. Specific examples thereof include a cyano group, an alkoxycarbonyl group, an aryloxycarbonyl group, a carbamoyl group, a sulfamoyl group, an alkylsulfonyl group, an arylsulfonyl group, a sulfoxido group, an acyl group, a heterocyclic group, a halogen atom, an alkyl halide group and a phosphoryl group. The σp constant is preferably from 0.2 to 2.0, and more preferably from 0.4 to 1.0. Among the preferred electron attractive groups as described above, particularly preferred electron attractive groups are a carbamoyl group, an alkoxycarbonyl group, an alkylsulfonyl group and an alkylphosphoryl group, and a carbamoyl group is most preferred among others. These groups may further have a substituent.

In the formula (III), Y preferably represents —C(=O)—, —SO— or —$SO_2$—, more preferably represents —C(=O)— or —$SO_2$—, and particularly preferably represents —$SO_2$—.

n represents 0 or 1, preferably represents 1.

When X represents an electron attractive group, X preferably represents a halogen atom, particularly preferably represents a bromine atom.

Then, specific examples of the compound represented by the formula (III), which can be used in the invention, are shown below.

(P-1)

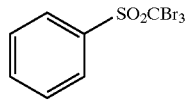

(P-2)

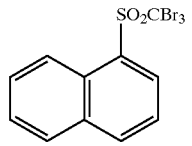

(P-3)

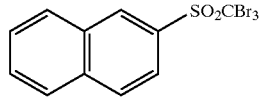

(P-4)

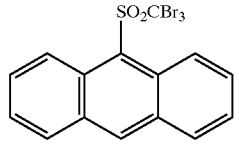

(P-5)

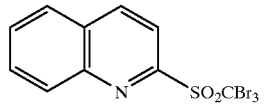

-continued
(P-6)
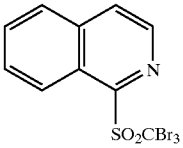
(P-7)
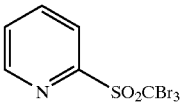
(P-8)
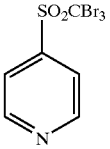
(P-9)
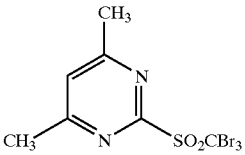
(P-10)
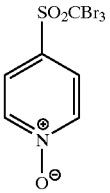
(P-11)
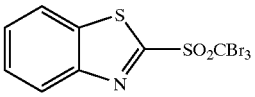
(P-12)
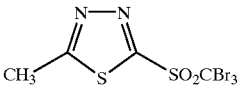
(P-13)
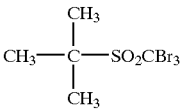
(P-14)
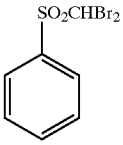
(P-15)
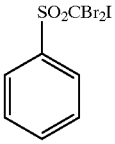
(P-16)
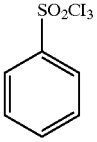
-continued
(P-17)
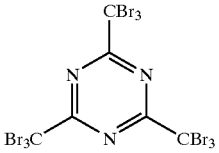
(P-18)
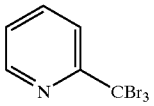
(P-19)
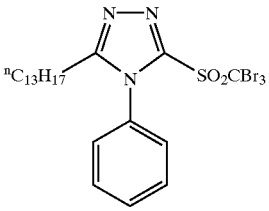
(P-20)
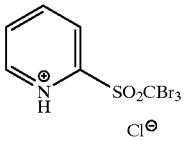
(P-21)
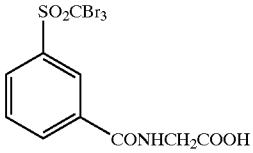
(P-22)
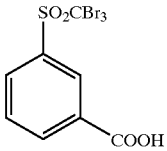
(P-23)
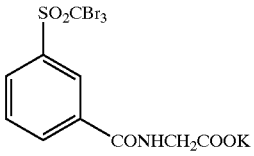
(P-24)
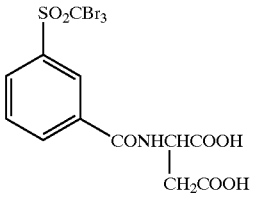
(P-25)
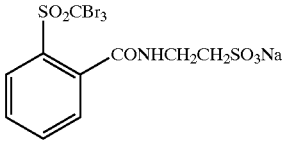

-continued
(P-26)
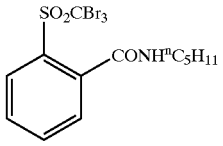
(P-27)
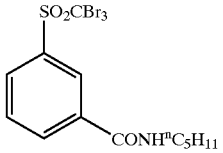
(P-28)
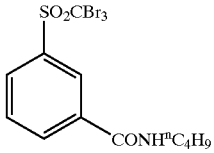
(P-29)
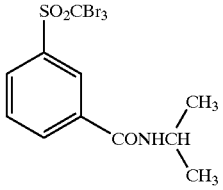
(P-30)
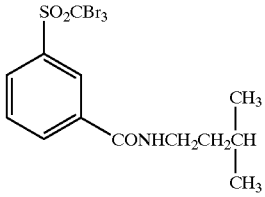
(P-31)
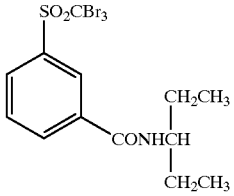
(P-32)
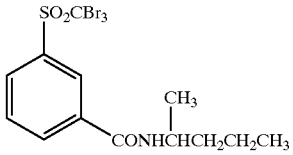
(P-33)
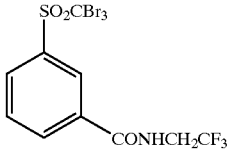
(P-34)
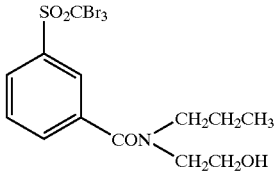
-continued
(P-35)
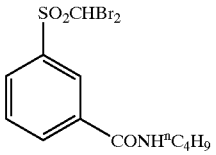
(P-36)
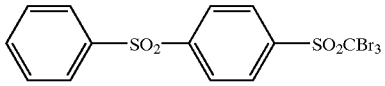
(P-37)
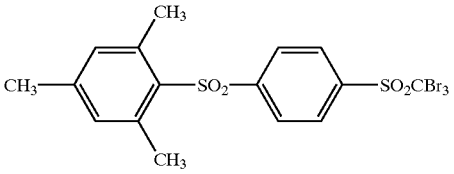
(P-38)
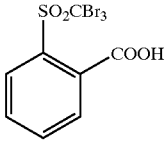
(P-39)
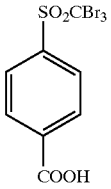
(P-40)
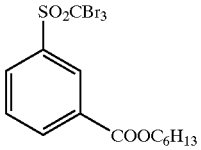
(P-41)
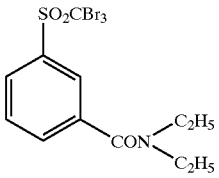
(P-42)
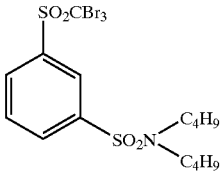
(P-43)
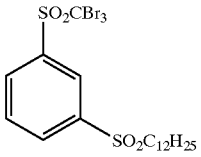

-continued (P-44)

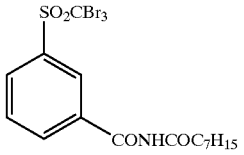

(P-45)

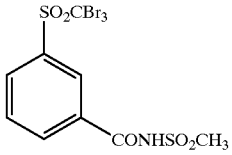

The compound represented by the formula (III), which is used in the invention, is used in the range of preferably from $10^{-4}$ to 1 mol, more preferably from $10^{-3}$ to 0.8 mol, and far more preferably from $5\times10^{-3}$ to 0.5 mol, per mol of the light-insensitive silver salt in the image forming layer.

In the invention, methods for adding the antifoggants to the light-sensitive materials include the methods described as the above-mentioned methods for adding the reducing agents, and the organic polyhalogen compounds are also preferably added as fine solid particle dispersions.

Other antifoggants include mercury (II) salts described in JP-A-11-65021, paragraph number 0113, benzoic acid derivatives described in JP-A-11-65021, paragraph number 0114, salicylic acid derivatives represented by formula (Z) of Japanese Patent Application No. Hei. 11-87297, formalin scavenger compounds represented by formula (S) of Japanese Patent Application No. Hei. 11-23995, triazine compounds according to claim 9 of JP-A-11-352624, compounds represented by formula (III) of JP-A-6-11791 and 4-hydroxy-6-methyl-1,3,3a,7-tetraazaindene.

The photothermographic materials of the invention may contain azolium salts for the purpose of fog prevention. The azolium salts include compounds represented by formula (XI) described in JP-A-59-193447, compounds described in JP-B-55-12581 and compounds represented by formula (II) described in JP-A-60-153039. Although the azolium salt may be added to any site of the light-sensitive material, it is preferably added to a layer on a side having the light-sensitive layer. More preferably, it is added to the organic silver salt-containing layer. The azolium salt may be added at any stage of the preparation of the coating solution. When added to the organic silver salt-containing layer, the azolium salt may be added at any stage from the preparation of the organic silver salt to the preparation of the coating solution, preferably from after the preparation of the organic silver salt to immediately before coating. The azolium salt may be added in any form such as a powder, a solution or a fine solid particle dispersion. Further, the azolium salt may be added as another solution in which it is mixed with another additive such as a sensitizing dye, a reducing agent or a color toning agent. In the invention, the azolium salt may be added in any amount, but preferably in an amount of $1\times10^{-6}$ to 2 mol, more preferably $1\times10^{-3}$ to 0.5 mol, per mol of silver.

In the invention, mercapto compounds, disulfide compounds or thione compounds can be contained, for inhibiting or accelerating development to control development, improving the spectral sensitizing efficiency and improving keeping quality before and after development. Examples of such compounds are described in JP-A-10-62899, paragraph numbers 0067 to 0069, JP-A-10-186572 (compounds represented by formula (I) and specific examples described in paragraph numbers 0033 to 0052), EP-A-0803764, page 20, lines 36 to 56 and Japanese Patent Application No. Hei. 11-273670. Mercapto-substituted heteroaromatic compounds are preferred among others.

Color toning agents are preferably added to the photothermographic materials of the invention. The color toning agents are described in JP-A-10-62899, paragraph numbers 0054 to 0055, EP-A-0803764, page 21, lines 23 to 48 and JP-A-2000-35631. Preferred are phthalazinone compounds (phthalazinone, phthalazinone derivatives or metal salts thereof, for example, 4-(1-naphthyl)phthalazinone, 6-chlorophthalazinone, 5,7-dimethoxyphthalazinone and 2,3-dihydro-1,4-phthalazinedione); combinations of phthalazinone compounds and phthalic acid compounds (e.g., phthalic acid, 4-methylphthalic acid, 4-nitrophthalic acid and tetrachlorophthalic acid anhydride); phthalazine compounds (phthalazine, phthalazine derivatives or metal salts thereof, for example, 4-(1-naphthyl)phthalazine, 6-isopropylphthalazine, 6-t-butylphthalazine, 6-chlorophthalazine, 5,7-dimethoxyphthalazine and 2,3-dihydrophthalazine); and combinations of phthalazine compounds and phthalic acid compounds. In particular, combinations of phthalazine compounds and phthalic acid compounds are preferred.

Plasticizers and lubricants which can be used in the light-sensitive layers of the photothermographic material of the invention, are described in JP-A-11-65021, paragraph number 0117, and super hard gradation enhancers for formation of super hard images are described in JP-A-11-65021, paragraph number 0118, JP-A-11-223898, paragraph numbers 0136 to 0193, Japanese Patent Application No. Hei. 11-87297 (compounds of formulas (H), (1) to (3), (A) and (B)) and Japanese Patent Application No. Hei. 11-91652 (compounds of formulas (III) to (V), specific compounds: "KA 21" to "KA 24"). Hard gradation accelerators are described in JP-A-11-65021, paragraph number 0102, and JP-A-11-223898, paragraph numbers 0194 to 0195.

For using formic acid or a formate as a strong fogging material, it is added to a side having a light-sensitive silver halide-containing image forming layer preferably in an amount of 5 mmol or less, and more preferably in an amount of 1 mmol or less, per mol of silver.

When the super hard gradation enhancers are used in the photothermographic materials of the invention, acids produced by hydration of diphosphorus pentaoxide or salts thereof are preferably used in combination therewith. The acids produced by hydration of diphosphorus pentaoxide or the salts thereof include metaphosphoric acid and salts thereof, pyrophosphoric acid and salts thereof, orthophosphoric acid and salts thereof, triphosphoric acid and salts thereof, tetraphosphoric acid and salts thereof, and hexametaphosphoric acid and salts thereof. Particularly preferred as the acids produced by hydration of diphosphorus pentaoxide or salts thereof are orthophosphoric acid and salts thereof, and hexametaphosphoric acid and salts thereof. Specific examples of the salts are sodium orthophosphate, sodium dihydrogenorthophosphate, sodium hexametaphosphate and ammonium hexametaphosphate.

The acids produced by hydration of diphosphorus pentaoxide or the salts thereof may be used in a desired amount depending on performances such as sensitivity and fog. However, the amount thereof used (the amount thereof coated per $m^2$ of light-sensitive material) is preferably from 0.1 to 500 $mg/m^2$, and more preferably from 0.5 to 100 $mg/m^2$.

The photothermographic material of the invention can be provided with a surface protective layer for preventing adhesion of the image forming layer. The surface protective layer may be composed of a single layer or multiple layers. The surface protective layers are described in JP-A-11-65021, paragraph numbers 0119 to 0120.

As a binder for the surface protective layer of the invention, gelatin is preferred. However, the use of polyvinyl alcohol (PVA) is also preferred. As the gelatin, there can be used inert gelatin (for example, Nitta gelatin 750) and phthalated gelatin (for example, Nitta gelatin 801). The PVA includes PVA-105, a completely saponified product, PVA-205 and PVA-335, partially saponified products, and MP-203, modified polyvinyl alcohol (the above are names of commercial products manufactured by Kuraray Co., Ltd.). The amount of polyvinyl alcohol coated (per $m^2$ of support) for every one protective layer is preferably from 0.3 to 4.0 $g/m^2$, and more preferably from 0.3 to 2.0 $g/m^2$.

In particular, when the photothermographic material of the invention is used for printing application in which changes in dimension cause trouble, it is preferred that a polymer latex is also used in the protective layer or a back layer. Such polymer latexes are described in *Synthetic Resin Emulsions*, edited by Taira Okuda and Hiroshi Inagaki, published by Kobunshi Kankokai (1978), *Application of Synthetic Latexes*, edited by Takaaki Sugimura, Yasuo Kataoka, Soichi Suzuki and Keiji Kasahara, published by Kobunshi Kankokai (1993) and Soichi Muroi, *Chemistry of Synthetic Latexes*, published by Kobunshi Kankokai (1970), and specific examples thereof include a methyl methacrylate (33.5% by weight)/ethyl acrylate (50% by weight)/methacrylic acid (16.5% by weight) copolymer latex, a methyl methacrylate (47.5% by weight)/butadiene (47.5% by weight)/itaconic acid (5% by weight) copolymer latex, an ethyl acrylate/methacrylic acid copolymer latex, a methyl methacrylate (58.9% by weight)/2-ethylhexyl acrylate (25.4% by weight)/styrene (8.6% by weight)/2-hydroxyethyl methacrylate (5.1% by weight)/acrylic acid (2.0% by weight) copolymer latex, and a methyl methacrylate (64.0% by weight)/styrene (9.0% by weight)/butyl acrylate (20.0% by weight)/2-hydroxyethyl methacrylate (5.0% by weight)/acrylic acid (2.0% by weight) copolymer latex. Further, as the binders for the surface protective layers, there may be applied combinations of polymer latexes described in Japanese Patent Application No. Hei. 11-6872, techniques described in Japanese Patent Application No. Hei. 11-143058, paragraph numbers 0021 to 0025, techniques described in Japanese Patent Application No. Hei. 11-6872, paragraph numbers 0027 to 0028, and techniques described in JP-A-2000-19678, paragraph numbers 0023 to 0041. The amount of the polymer latex in the surface protective layer is preferably from 10% to 90% by weight, and more preferably from 20% to 80% by weight, based on the total binder.

The amount of the total binder (including a water-soluble polymer and the polymer latex) coated (per $m^2$ of support) for every one surface protective layer is preferably from 0.3 to 5.0 $g/m^2$, and more preferably from 0.3 to 2.0 $g/m^2$.

In the invention, the preparation temperature of the coating solutions for the image forming layers is preferably from 30° C. to 65° C., more preferably from 35° C. to less than 60° C., and still more preferably from 35° C. to 55° C. Further, the temperature of the coating solutions for the image forming layers immediately after addition of the polymer latexes is preferably maintained at a temperature of 30° C. to 65° C. Furthermore, it is preferred that the reducing agents and the organic silver salts are mixed before addition of the polymer latexes.

The image forming layer used in the invention is constituted on a support as one or more layers. When constituted by one layer, the layer comprises the organic silver salt, the light-sensitive silver halide, the reducing agent and the binder, and optionally, additional materials such as the color toning agent, an auxiliary coating agent and other auxiliary agents. When constituted by two or more layers, a first image forming layer (usually, a layer adjacent to the support) contains the organic silver salt and the light-sensitive silver halide, and a second image forming layer or both layers must contain some other components. The structure of a multicolor light-sensitive heat-developable photographic material may contain a combination of these two layers for each color, or all components in a single layer as described in U.S. Pat. No. 4,708,928. In the case of a multi-dye multicolor light-sensitive heat-developable photographic material, respective emulsion layers are generally kept distinguished from each other by using a functional or nonfunctional barrier layer between respective light-sensitive layers, as described in U.S. Pat. No. 4,460,681.

The light-sensitive layers of the photothermographic material of the invention can contain various kinds of dyes and pigments (e.g., C.I. Pigment Blue 60, C.I. Pigment Blue 64 and C.I. Pigment Blue 15:6) from the viewpoints of improvement in a color tone, prevention of the occurrence of interference fringes at laser exposure and prevention of irradiation. These are described in detail in WO98/36322, JP-A-10-268465 and JP-A-11-338098.

In the photothermographic material of the invention, an antihalation layer can be provided on the side far away from a light source with respect to the light-sensitive layer.

The photothermographic materials generally have light-insensitive layers, in addition to the light-sensitive layers. The light-insensitive layers can be classified into four types: (1) a protective layer provided on the light-sensitive layer (on the side far away from the support), (2) an intermediate layer provided between the plurality of light-sensitive layers or between the light-sensitive layer and the protective layer, (3) an undercoat layer provided between the light-sensitive layer and the support, and (4) a back layer provided on the side opposite to the light-sensitive layer. The light-sensitive layer is provided with a filter layer as the layer of (1) or (2), and with an antihalation layer as the layer of (3) or (4).

The antihalation layers are described in JP-A-11-65021, paragraph numbers 0123 to 0124, JP-A-11-223898, JP-A-9-230531, JP-A-10-36695, JP-A-10-104779, JP-A-11-231457, JP-A-11-352625 and JP-A-11-352626.

The antihalation layer contains an antihalation dye having absorption at an exposure wavelength. When the exposure wavelength is in the infrared region, an infrared absorption dye is used, and in that case, a dye having no absorption in the visible region is preferably used.

When halation is prevented by using a dye having absorption in the visible region, it is preferred that the color of the dye does not substantially remain after image formation. For that purpose, a means of decoloring the dye by heat of heat development is preferably used, and particularly, it is preferred that a heat decoloring dye and a base precursor are added to the light-insensitive layer to allow it to act as an antihalation layer. These techniques are described in JP-A-11231457.

The amount of the decoloring dye added is determined depending on its purpose. In general, it is used in such an amount that an optical density (absorbance) exceeding 0.1 is given when measured at a desired wavelength. The optical density is preferably from 0.2 to 2. The amount of the dyes used for obtaining such optical density is generally from about 0.001 to about 1 $g/m^2$.

Such decoloring of the dyes allows the optical density after heat development to decrease to 0.1 or less. Two or more kinds of decoloring dyes may be used together in heat-decolorable recording materials or photothermographic materials. Similarly, two or more kinds of base precursors may be used together.

In heat decoloring using such decoloring dyes and base precursors, it is preferred in terms of heat decoloring properties that they are used in combination with substances (e.g., diphenyl sulfone and 4-chlorophenyl(phenyl) sulfone) decreasing the melting point by 3° C. or more by mixing with the base precursors as described in JP-A-11-352626.

In the invention, for improving the silver tone and the variation of images with the elapse of time, a coloring agent having the absorption maximum at 300 to 450 nm can be added. Such coloring agents are described in JP-A-62-210458, JP-A-63-104046, JP-A-63-103235, JP-A-63-208846, JP-A-63-306436, JP-A-63-314535, JP-A-01-61745 and Japanese Patent Application No. Hei. 11-276751.

Such a coloring agent is usually added in an amount ranging from 0.1 mg/m$^2$ to 1 g/m$^2$, and preferably added to a back layer provided on the side opposite to the light-sensitive layer.

It is preferred that the photothermographic material of the invention is a so-called single-sided light-sensitive material having at least one silver halide emulsion-containing light-sensitive layer on one side of the support and the back layer on the other side.

In the invention, a matte agent is preferably added for improving the transferring properties. The matte agents are described in JP-A-11-65021, paragraph numbers 0126 to 0127. When indicated by the amount coated per m$^2$ of light-sensitive material, the amount of the matte agent coated is preferably from 1 to 400 mg/m$^2$, and more preferably from 5 to 300 mg/m$^2$.

The matte degree of an emulsion surface may be any, as long as no stardust trouble occurs. However, the Beck smoothness is preferably from 30 to 2,000 seconds, and particularly preferably from 40 to 1,500 seconds. The Beck smoothness can be easily determined by the Japanese Industrial Standard (JIS) P8119, "Smoothness Test Method of Paper and Paperboard with Beck Tester" and the TAPPI Standard T479.

In the invention, the Beck smoothness of the back layer is preferably from 10 to 1,200 seconds, more preferably from 20 to 800 seconds, and still more preferably from 40 to 500 seconds.

In the invention, the matte agent is preferably contained in the outermost surface layer, a layer which functions as the outermost surface layer, or a layer close to the outer surface, of the light-sensitive material, and preferably contained in a layer which functions as the so-called protection layer.

The back layers applicable to the invention are described in JP-A-11-65021, paragraph numbers 0128 to 0130.

In the photothermographic materials of the invention, the film surface pH before heat development processing is preferably 6.0 or less, and more preferably 5.5 or less. Although there is no particular limitation on the lower limit thereof, it is about 3. It is preferred from the viewpoint of reducing the film surface pH that the film surface pH is adjusted with organic acids such as phthalic acid derivatives, nonvolatile acids such as sulfuric acid, or volatile bases such as ammonia. In particular, ammonia is volatile and removable before the coating stage or heat development, so that it is preferred in that the low film surface pH is achieved. A method for measuring the film surface pH is described in Japanese Patent Application No. Hei. 11-87297, paragraph number 0123.

A hardener may be used in each layer of the light-sensitive layer, the protective layer and the back layer of the photothermographic material of the invention. Examples of the hardeners are described in T. H. James, *THE THEORY OF THE PHOTOGRAPHIC PROCESS FOURTH EDITION*, pages 77 to 87, published by Macmillan Publishing Co., Inc. (1977), and multivalent metal ions described in ibid., page 78, polyisocyanates described in U.S. Pat. No. 4,281,060 and JP-A-6-208193, epoxy compounds described in U.S. Pat. No. 4,791,042 and vinyl sulfone compounds described in JP-A-62-89048, as well as chrome alum, 2,4-dichloro-6-hydroxy-s-triazine sodium salt, N,N-ethylenebis(vinyl sulfonacetoamide) and N,N-propylenebis(vinyl sulfonacetoamide), are preferably used.

The hardeners are added as solutions, and the solutions are preferably added to the coating solutions for protective layer from 180 minutes before coating to immediately before coating, preferably from 60 minutes before coating to 10 seconds before coating. However, there is no particular limitation on the mixing process and the mixing conditions, as long as the effects of the present invention are sufficiently manifested. Specific examples of the mixing processes include a mixing process using a tank designed so that the average residence time calculated from the flow rate of the solution added and the amount of the solution supplied to a coater becomes a desired time, and a process using a static mixer described in N. Harnby, M. F. Edwards and A. W. Nienow, translated by Koji Takahashi, *Liquid Mixing Techniques*, chapter 8, published by Nikkan Kogyo Shinbunsha (1989).

Surface active agents other than the surface active agents represented by the formula (F) which can be used in the present invention are described in JP-A-11-65021, paragraph number 0132, solvents in the same, paragraph number 0133, supports in the same, paragraph number 0134, antistatic or conductive layers in the same, paragraph number 0135, methods for obtaining color images in the same, paragraph number 0136, and lubricants in JP-A-11-84573, paragraph numbers 0061 to 0064 and Japanese Patent Application No. Hei. 11-106881, paragraph numbers 0049 to 0062.

As supports which can be used in the present invention, there are preferably used transparent polyester films, particularly transparent polyethylene terephthalate films subjected to heat treatment within the temperature range of 130° C. to 185° C. for relaxing internal strain remaining in the films in biaxial stretching to remove heat shrinkage strain generated in heat development processing. In the case of photothermographic materials for medical application, the transparent supports may be either colored with blue dyes (for example, dye-1 described in JP-A-8-240877, Example), or not colored. It is preferred that undercoating techniques of water-soluble polyesters described in JP-A-11-84574, styrene-butadiene copolymers described in JP-A-10-186565 and vinylidene chloride copolymers described in Japanese Patent Application No. Hei. 11-106881, paragraph numbers 0063 to 0080 are applied to the supports. Further, techniques described in JP-A-56-143430, JP-A-56-143431, JP-A-58-62646, JP-A-56-120519, JP-A-11-84573, paragraph numbers 0040 to 0051, U.S. Pat. No. 5,575,957 and JP-A-11-223898, paragraph numbers 0078 to 0084 can be applied to the antistatic layers and undercoating.

The photothermographic materials of the invention are preferably of a mono-sheet type (a type in which images can be formed on the photothermographic materials without the use of other sheets such as image receiving materials).

Anti-oxidizing agents, stabilizers, plasticizers, ultraviolet absorbers and coating aids may be further added to the photothermographic materials of the invention. Various additives are added to either the light-sensitive layers or the light-insensitive layers. For these additives, reference can be made to WO98/36322, EP-A-803764, JP-A-10-186567 and JP-A-10-18568.

The photothermographic materials of the invention may be applied by any methods. Specifically, various coating operations including extrusion coating, slide coating, curtain coating, dip coating, knife coating, flow coating and extrusion coating using a hopper described in U.S. Pat. No. 2,681,294 are used. Extrusion coating described in Stephen F. Kistler and Petert M. Schweizer, *LIQUID FILM COATING*, pages 399 to 536, published by CHAPMAN & HALL (1997) or slide coating is preferably used, and slide coating is particularly preferably used. Examples of the shapes of slide coaters used in slide coating are shown in *ibid.,* FIG. 11*b*. 1 on page 427. Two or more layers can be formed at the same time by methods described in *ibid.,* pages 399 to 536, U.S. Pat. No. 2,761,791 and G.B. Patent 837,095, as so desired.

The coating solutions for the organic silver salt-containing layers used in the invention are preferably so-called thixotropic fluids. The thixotropy means the property that the viscosity decreases with an increase in the shear rate. Although any instruments may be used for measurement of the viscosity, an RFS fluid spectrometer manufactured by Rheometrics Far East Co. is preferably used and measurements are made at 25° C. Here, for the coating solutions for the organic silver salt-containing layers used in the invention, the viscosity at a shear rate of 0.1 $S^{-1}$ is preferably from 400 to 100,000 mPa·s, and more preferably from 500 to 20,000 mPa·s. Further, the viscosity at a shear rate of 1,000 $S^{-1}$ is preferably from 1 to 200 mPa·s, and more preferably from 5 to 80 mPa·s.

Various kinds of systems exhibiting the thixotropy are known, and described in *Koza Rheology* (*Course Rheology*), edited by Kobunshi Kankokai, and Muroi and Morino, *Polymer Latexes* (published by Kobunshi Kankokai. For allowing fluids to exhibit the thixotropy, they are required to contain many fine solid particles. Further, for enhancing the thixotropy, it is effective to contain thickening linear polymers, to increase the aspect ratio by the anisotropic form of the fine solid particles contained, and to use alkali thickening agents and surfactants.

Techniques which can be used in the photothermographic materials of the invention are also described in EP-A-803764, EP-A-883022, WO98/36322, JP-A-56-62648, JP-A-58-62644, JP-A-9-281637, JP-A-9-297367, JP-A-9-304869, JP-A-9-311405, JP-A-9-329865, JP-A-10-10669, JP-A-10-62899, JP-A-10-69023, JP-A-10-186568, JP-A-10-90823, JP-A-10-171063, JP-A-10-186565, JP-A-10-186567, JP-A-10-186569 to JP-A-10-186572, JP-A-10-197974, JP-A-10-197982, JP-A-10-197983, JP-A-10-197985 to JP-A-10-197987, JP-A-10-207001, JP-A-10-207004, JP-A-10-221807, JP-A-10-282601, JP-A-10-288823, JP-A-10-288824, JP-A-10-307365, JP-A-10-312038, JP-A-10-339934, JP-A-11-7100, JP-A-11-15105, JP-A-11-24200, JP-A-11-24201, JP-A-11-30832, JP-A-11-84574, JP-A-11-65021, JP-A-11-109547, JP-A-11-125880, JP-A-11-129629, JP-A-11-133536 to JP-A-11-133539, JP-A-11-133542, JP-A-11-133543, JP-A-11-223898 and JP-A-11-352627.

Although the photothermographic materials of the invention may be developed by any methods, the photothermographic materials exposed imagewise are usually developed by elevating the temperature thereof. The developing temperature is preferably from 80° C. to 250° C., and more preferably from 100° C. to 140° C. The developing time is preferably from 1 to 180 seconds, more preferably from 10 to 90 seconds, and particularly preferably from 10 to 40 seconds.

As the heat development system, a plate heater system is preferred, and as the heat development system according to the plate heater system, a method described in JP-A-11-133572 is preferred. In this method, a heat development apparatus giving visible images by contacting the photothermographic material having latent images formed with a heating means in a heat development unit is used, wherein the heating means comprises a plate heater, a plurality of press rollers are arranged along one side surface of the plate heater, facing thereto, and the photothermographic material is allowed to pass between the press rollers and the plate heater to conduct heat development. It is preferred that the plate heater is divided into 2 to 6 steps and the temperature is decreased by about 1° C. to about 10° C. at a leading edge portion thereof. Such a method is also described in JP-A-54-30032, and water and an organic solvent contained in the photothermographic material can be removed outside the system. Further, changes in the support form of the photothermographic material caused by rapid heating thereof can also be inhibited.

Although the light-sensitive materials of the invention may be exposed by any methods, laser light is preferably used as an exposure light source. Preferred examples of the lasers used in the invention include a gas laser ($Ar^+$ or He—Ne), a YAG laser, a dye laser and a semiconductor laser. Further, a semiconductor laser and a second harmonic generating element can also be used in combination. Preferred is a red- to infrared-emitting gas laser or a semiconductor laser.

Laser imagers for medical application provided with exposure units and heat development units include a Fuji medical dry laser imager, FM-DP L. FM-DP L is described in *Fuji Medical Review*, No. 8, pages 39 to 55, and needless to say, this technique is applied as the laser imager for the photothermographic material of the invention. Further, this can also be applied as the photothermographic material for the laser imager in an "AD network" proposed by Fuji Medical System as a network system adapted to the DICOM standard.

The photothermographic materials of the invention form black and white images according to silver images, and preferably used as photothermographic materials for medical diagnosis, photothermographic materials for industrial photography, photothermographic materials for printing and photothermographic materials for COM.

Then, the invention is explained by the examples but the invention is not limited to them.

EXAMPLE 1

The structures of the compounds used in the examples are shown below.

Spectral sensitizing dye A

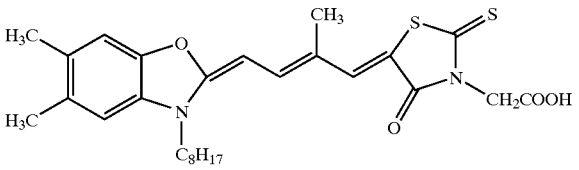

-continued

Tellurium sensitizing dye B

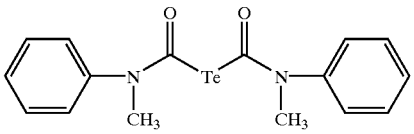

Base precursor compound 11

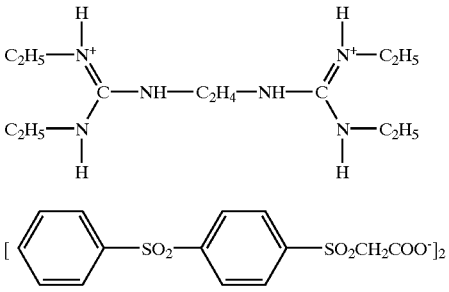

Cyanine dye compound 13

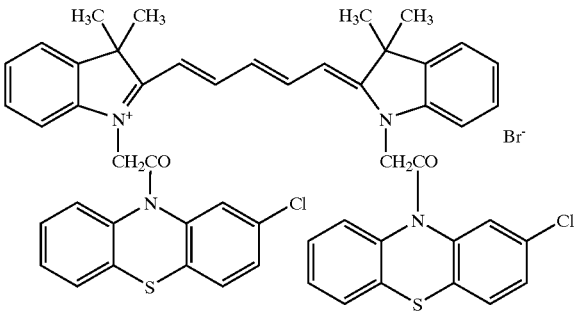

Blue dye compound 14

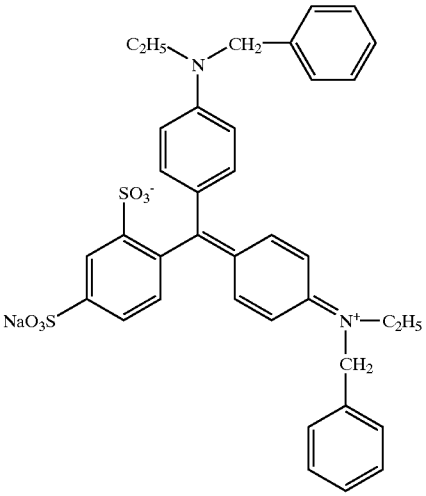

Yellow dye compound 15

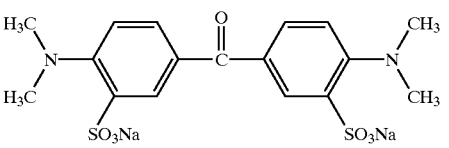

FC-1

$C_8F_{17}SO_2NCH_2{\bullet}COOK$
$|$
$C_3H_7$

-continued

FC-2

$C_8F_{17}SO_2{-}N(C_3H_7){-}CH_2CH_2(O{-}CH_2CH_2)_nOH$ $n = 14.9$

FC-3

$C_8F_{17}SO_3K$ (Preparation of PET Support)

Using terephthalic acid and ethylene glycol, according to an ordinary method, PET having a specific viscosity IV=0.66 (measured in phenol/tetrachloroethane=6/4 (weight ratio) at 25° C.) was obtained. After forming pellets from the polymer, the pellets were dried at 130° C. for 4 hours, after melting at 300° C., the molten pellets were extruded from a T-type die and quickly cooled to prepare an unstretched film having a thickness that the film thickness after thermal fixing became 175 μm. The film was stretched to the lengthwise direction 3.3 times using rolls each having a different peripheral speed and then stretched to the width direction 4.5 times by a tenter. In this case, the temperatures were 110° C. and 130° C. respectively. Thereafter, after thermally fixing at 240° C. for 20 seconds, the film was relaxed 4% to the width direction at the same temperature. Then, after slitting the chuck portion of the tenter, knurl work was applied to both ends, the film was wound at 4 kg/cm$^2$ to obtain a roll of the film having a thickness of 175 μm.

(Surface Corona Treatment)

Using a solid state corona treating machine, Model 6 KVA, manufactured by Pillar Co., both surfaces of the support were treated at room temperature at 20 meters/minute. In this case, from the values of the electric current and the electric voltage, it was confirmed that the treatment of 0.375 kV·A·minute/m$^2$ was applied to the support. In this case, the treatment frequency was 9.6 kHz and the gap clearance between the electrode and the dielectric roll was 1.6 mm.

(Preparation of Subbed Support)

(1) Preparation of Coating Solution of Subbing Layer

| Formula (1) (for subbing layer of the light-sensitive layer side) | |
|---|---|
| Pesresin A-515GB (30 wt. % solution) manufactured by Takamtsu Yushi K.K. | 234 g |
| Polyethylene glycol monononyl phenyl ether (mean ethylene oxide No. = 8.5) 10 wt. % soln. | 21.9 g |
| MP-1000 (polymer fine particles, mean particle size 0.4 μm, made by Soken Kagaku K.K.) | 0.91 g |
| Distilled water | 744 ml |

| Formula (2) (for the 1st back layer) | |
|---|---|
| Styrene-butadiene copolymer latex (solid components 40 wt. %, styrene/butadiene wt. ratio = 68/32) | 158 g |
| 2,4-Dichloro-6-hydroxy-S-triazine sodium salt 8 wt. % aqueous solution | 20 g |
| Sodium laurylbenzenesufonate 1 wt. % aq. soln. | 10 ml |
| Distilled water | 854 ml |

| Formula (3) (for 2nd layer of back layer side) | |
|---|---|
| $SnO_2$/SbO (9/1 wt. ratio, mean particle size 0.038 μm, 17 wt. % dispersion) | 84 g |
| Gelatin (10 wt. % aqueous solution) | 89.2 g |
| Metrose TC-5 (2 wt. % aqueous solution) made by Shin-Etsu Chemical Co., Ltd.) | 8.6 g |
| MP-1000, made by Soken Kagaku K.K. | 0.01 g |
| Sodium dodecylbenzenesulfonate 1 wt. % aq. soln. | 10 ml |
| NaOH (1 wt. %) | 6 ml |
| Proxel (made of I. C. I. Co.) | 1 ml |
| Distilled water | 805 ml |

(Preparation of Subbed Support)

After applying the above-described corona discharging treatment to both surfaces of the above-described biaxially stretched polyethylene terephthalate support having the thickness of 175 μm, the above-described formula (1) of the subbing coating solution was coated on one surface thereof by a wire bar such that the wet coated amount became 6.6 ml/m$^2$ (per one surface) and dried at 180° C. for 5 minutes. Then, the above-described formula (2) for the subbing coating solution was coated on the back surface by a wire bar such that the wet coating amount became 5.7 ml/m$^2$ followed by drying at 180° C. for 5 minutes, and further the above-descried formula (3) for the subbing coating solution was coated on the back surface by a wire bar such that the wet coated amount became 7.7 ml/m$^2$ followed by drying at 180° C. for 6 minutes to prepare a subbed support.

(Preparation of Coating Solution of Back Surface)

(Preparation of Solid Fine Particle Dispersion (a) of Base Precursor)

A mixture of 64 g of the base precursor compound 11, 28 g of diphenylsulfone, 10 g of a surface active agent, Demor N manufactured by Kao Corporation, and 220 ml of distilled water was beads dispersed using a sand mill (¼ Gallon Sand Grinder Mill, manufactured by AIMEX Corporation) to obtain the solid fine particle dispersion (a) of the base precursor compound having a mean particle size of 0.2 μm.

(Preparation of Dye Solid Fine Particle Dispersion)

A mixture of 9.6 g of the cyanine dye compound 13, 5.8 g of sodium p-dodecylbenzenesulfonate, and 305 ml of distilled water was beads dispersed using a sand mild (¼ Gallon Sand Grinder Mill, manufactured by AIMEX Corporation) to obtain a dye solid fine particle dispersion having a mean particle size of 0.2 μm.

(Preparation of Coating Solution of Antihalation Layer)

By mixing 17 g of gelatin, 9.6 g of polyacrylamide, 70 g of the above-described solid fine particle dispersion (a) of the base precursor, 56 g of the above-described dye solid fine particle dispersion, 1.5 g of polymethyl methacrylate fine particles (mean particle size 6.5 μm), 0.03 g of benzoisothiazolinone, 2.2 g of sodium polyethylenesulfonate, 0.2 g of the blue dye compound 14, 3.9 g of the yellow dye compound 15, and 844 ml of water, the coating solution of an antihalation layer was prepared.

(Preparation of Coating Solution of Protective Layer for Back Surface)

In a vessel maintained at 40° C., by mixing 50 g of gelatin, 0.2 g of sodium polystyrenesulfonate, 2.4 g of N,N-ethylenebis(vinylsulfonacetamide), 1 g of sodium t-octylphenoxyethanesulfonate, 30 ml of benzoisothiazolinone, 37 mg of N-perfluorooctylsulfonyl-N-propylalanine potassium salt, 0.15 g of polyethylene glycol mono(N-perfluorooctylsulfonyl-N-propyl-2-aminoethyl) ether (ethylene oxide average polymerization degree 15), 32 mg of $C_8F_{17}SO_3K$, 64 mg of $C_8F_{17}SO_2(C_3H_7)(CH_2CH_2O)_4(CH_2)_4$—$SO_3Na$, 8.8 g of an acrylic acid/ethyl acrylate copolymer (copolymerization weight ratio 5/95), 0.6 g of Aerosol OT (manufactured by American Cyanamid Company), 1.8 g of a fluid paraffin emulsion as fluid paraffin, and 950 ml of water, a coating solution of a protective layer for the back surface was prepared.

(Preparation of Silver Halide Emulsion 1)

To 1421 ml of distilled water was added 3.1 ml of a solution of 1% by weight potassium bromide, and further 3.5 ml of sulfuric acid of 0.5 mol/liter in concentration and 31.7 g of phthalated gelatin were added thereto. The solution obtained was stirred in a stainless steel-made reaction jar at a solution temperature of 34° C., and the total amounts of a solution A obtained by adding distilled water to 22.22 g of silver nitrate to dilute to 95.4 ml and a solution B obtained by adding distilled water to 15.9 g of potassium bromide to dilute to 97.4 ml were added at a definite flow rate over a period of 45 seconds. Thereafter, 10 ml of an aqueous solution of 3.5% by weight hydrogen peroxide was added to the mixture and further 10.8 ml of 10% by weight benzimidazole was added thereto. Furthermore, the whole amount of a solution C obtained by adding distilled water to 51.86 g of silver nitrate to dilute to 317.7 ml was added thereto at a definite flow rate over a 20 minutes period and a solution D obtained by adding distilled water to 45.8 g of potassium bromide to dilute to 400 ml was added thereto by a controlled double jet method while keeping the pAg at 8.1. The whole amount of potassium hexachloroiridate(III) was added 10 minutes after the initiation of the additions of the solution C and the solution D such that the content thereof became $1\times10^{-4}$ mol per mol of silver. Also, the whole amount of an aqueous solution of potassium iron(II) hexacyanide was added 5 seconds after the finish of the addition of the solution C such that the content became $3\times10^{-4}$ mol per mol of silver. The pH of the mixture was adjusted to 3.8 using sulfuric acid having a concentration of 0.5 mol/liter, stirring was stopped, and then precipitation/desalting/water washing steps were carried out. Then the pH was adjusted to 5.9 using an aqueous solution of sodium hydroxide having a concentration of 1 mol/liter to prepare a silver halide dispersion having the pAg of 8.0.

The above-described silver halide dispersion was kept at 38° C. with stirring, 5 ml of a methanol solution of 0.34% by weight 1,2-benzoisothiazolin-3-one was added, after 40 minutes, a methanol solution of the spectral sensitizing dye A was added in an amount of $1\times10^{-3}$ mol per mol of silver, and after one minute, the temperature was raised to 47° C. Twenty minutes after the temperature raising, a methanol solution of sodium benzenethiosulfonate was added at $7.6\times10^{-5}$ mol per mol of silver, and further after 5 minute since then, a methanol solution of the tellurium sensitizer B was added at $1.9\times10^{-4}$ mol per mol of silver followed by carrying out ripening for 91 minutes. Then, 1.3 ml of a methanol solution of 0.8% by weight N,N'-dihydroxy-N"-diethylmelamine was added, and after 4 minutes since then, a methanol solution of 5-methyl-2-mercaptobenzimidazole was added at $3.7\times10^{-3}$ mol per mol of silver and also a methanol solution of 1-phenyl-2-heptyl-5-mercapto-1,3,4-triazole was added at $4.9\times10^{-3}$ mol per mol of silver to prepare a silver halide emulsion 1.

The silver halide grains in the silver halide emulsion prepared were pure silver bromide grains having a mean equivalent sphere diameter of 0.046 μm and the variation coefficient of the equivalent sphere diameters of 20%. The grain sizes, etc., were obtained from the average of 1000 grains using an electron microscope. The {100} face ratio of the grains was determined to be 80% using a Kubelka-Munk method.

(Preparation of Silver Halide Emulsion 2)

By following the same procedure as the preparation of the silver halide emulsion 1 except that the solution temperature 34° C. at the grain formation was changed to 49° C., the addition time of the solution C was changed to 30 minutes, and potassium iron(II) hexacyanide was not added, a silver halide emulsion 2 was prepared. As the case of the silver halide emulsion 1, precipitation/desalting/water washing/dispersion steps were carried out. Furthermore, as the case of the emulsion 1 except that the addition amount of the spectral sensitization dye A was changed to $7.5\times10^{-4}$ mol per mol of silver, the addition amount of the tellurium sensitizer B was changed to $1.1\times10^{-4}$ mol per mol of silver, and the addition amount of 1-phenyl-2-heptyl-5-mercapto-1,3,4-triazole was changed to $3.3\times10^{-3}$ mol to mol of silver, the spectral sensitization, the chemical sensitization, and the addition of 5-methyl-2-mercaptobenzimidazole and 1-phenyl-2-heptyl-5-mercapto-1,3,4-triazole were carried out to obtained the silver halide emulsion 2. The emulsion grains of the silver halide emulsion 2 were pure silver bromide cubic grains having a mean equivalent sphere diameter of 0.080 μm and the variation coefficient of equivalent sphere diameters of 20%.

(Preparation of Silver Halide Emulsion 3)

By following the same procedure as the preparation of the silver halide emulsion 1 except that the solution temperature 34° C. at the grain formation was changed to 27° C., a silver halide emulsion 3 was prepared. Also, as the case of the silver halide emulsion 1, precipitation/desalting/water washing/dispersion steps were carried out. By the same manner as the case of the emulsion 1 except that the addition amount of the spectral sensitizing A was changed to $6\times10^{-3}$ mol per mol of silver as the solid dispersion (aqueous gelatin solution), and the addition amount of the tellurium sensitizer B was changed to $5.2\times10^{-4}$ mol per mol of silver, the silver halide emulsion 3 was obtained. The emulsion grains of the silver halide emulsion 3 were pure silver bromide cubic grains having a mean equivalent sphere diameter of 0.038 μm and the variation coefficient of equivalent sphere diameters of 20%.

(Preparation of Mixed Emulsion A for Coating Solution)

After mixing 70% by weight the silver halide emulsion 1, 15% by weight the silver halide emulsion 2, and 15% by weight of the silver halide emulsion 3, an aqueous solution of 1% by weight of benzothiazolium iodide was added to the mixture at $7\times10^{-3}$ mol per mol of silver to prepare the mixed emulsion A for coating solution.

(Preparation of Fatty Acid Silver Salt Dispersion)

After mixing 87.6 kg of behenic acid (Edenor C22-85R, trade name, manufactured by Henkel Co.), 423 liters of distilled water, 49.2 liters of an aqueous solution of 5 mol/liter of NaOH, and 120 liters of tert-butanol, the reaction was carried out with stirring at 75° C. for one hour to obtain a solution of sodium behenate. Apart from this, 206.2 liters of an aqueous solution of 40.4 kg of silver nitrate (pH 4.0) was prepared and kept at 10° C. A reaction vessel containing 635 liters of distilled water and 30 liters of tert-butanol was kept at 30° C., and the total amount of the above-described sodium behenate solution and the total amount of the aqueous silver nitrate solution were added with stirring at definite flow rates over periods of 62 minutes and 10 seconds and 60 minutes respectively. In this case, the additions of the solutions were carried out such that for 7 minutes and 20 seconds after initiating the addition of the aqueous silver nitrate solution, the aqueous silver nitrate solution only was added, and thereafter, the addition of the aqueous sodium behenate solution was initiated, and for 9 minutes and 30 seconds after finishing the addition of the aqueous silver nitrate solution, the sodium behenate solution only was added. In this case, the temperature in the reaction vessel was 30° C. and the outer temperature was controlled so that the solution temperature became constant. Further, a pipe of an addition system of the sodium behenate solution was insulated with steam trace, and the opening of a valve for steam was controlled so that the solution temperature at an outlet of a tip of an addition nozzle became 75° C. Also, piping of the addition system of the aqueous silver nitrate solution was kept warm by circulating cold water through an out side of a double pipe. The adding position of the aqueous sodium behenate solution and the adding position of the aqueous silver nitrate were symmetrical disposition with the stirring axis at the center, and also the positions were controlled at the heights of not contacting with the reaction solution.

After finishing the addition of the sodium behenate solution, the mixture was allowed to stir at the temperature for 20 minutes and then the temperature was lowered to 25° C. Thereafter, solid component was collected by a suction filtration and was washed with water until the electric conductivity of the filtrate became 30 μS/cm. Thus, the fatty acid silver salt was obtained. The solid component was stored as a wet cake without drying.

When the form of the silver behenate grains obtained were evaluated from an electron microphotograph, the grains were flaky crystals having a=0.14 μm, b=0.4 μm, and c=0.6 μm in mean values (a, b, and c were defined above), an average aspect ratio of 5.2, an average equivalent sphere diameter of 0.52 μm, and the variation coefficient of the equivalent sphere diameters of 15%.

To the wet cake corresponding to 100 g of dry solid component were added 7.4 g of polyvinyl alcohol (PVA-217, trade name) and water to make 385 g of the total amount and the mixture was pre-dispersed by a homo-mixer.

Then, the pre-dispersed solution was treated 3 times by a dispersing machine (Microfluidizer M-110S-EH, trade name, manufactured by Microfluidex International Corporation, the use of G10Z intraction chamber) by controlling the pressure to 1750 kg/cm$^2$ to obtain a silver behenate dispersion. The cooling operation was carried out by mounting each of a coiled heat exchanger to before and behind of an interaction chamber and controlling the temperature of the refrigerant, whereby the dispersing temperature was established to 18° C.

(Preparation of 25% By Weight Dispersion of Reducing Agent)

To 10 kg of 1,1-bis(2-hydroxy-3,5-dimethylphenyl)-3,5,5-trimethylhexane and 10 g of an aqueous solution of 20% by weight modified polyvinyl alcohol (Poval MP203, manufactured by KURARAY CO., LTD.) was added 16 kg of water followed by mixing well to form a slurry. The slurry was sent by a diaphragm pump and dispersed by a horizontal sand mill (UVM-2: AIMEX Corporation) packed with zirconia beads having a mean diameter of 0.5 mm for 3 hours and 30 minutes, and thereafter, 0.2 g of a benzoisothiazolinone sodium salt and water were added to control such that the concentration of the reducing agent became 25% by weight to obtain a reducing agent dispersion. In the reducing agent particles contained in the reducing agent dispersion thus obtained, the median size was 0.42 μm and the largest particle size was not larger than 2.0 μm. The reducing agent dispersion was filtered with a polypropylene-made filter having a pore size of 10.0 μm to remove foreign matters such as dusts, etc., and stored.

(Preparation of 25% By Weight Dispersion of Reducing Agent Complex)

To 10 kg of a 1:1 complex of 2,2-methylenebis(4-ethyl-6-tert-butylphenol) and triphenylenephosphine oxide and 10 kg of an aqueous solution of 20% by weight modified polyvinyl alcohol (Poval MP203, manufactured by KURARAY CO., LTD.) was added 16 kg of water and the mixture was stirred well to form a slurry. The slurry was sent by a diaphragm pump and dispersed by a horizontal sand mill (UVM-2: AIMEX Corporation) packed with zirconia beads having a mean diameter of 0.5 mm for 3 hours and 30 minutes, and thereafter, 0.2 g of a benzoisothiazolinone sodium salt and water were added to control such that the concentration of the reducing agent became 25% by weight to obtain a reducing agent complex dispersion. In the reducing agent complex particles contained in the reducing agent complex dispersion thus obtained, the median size was 0.46 μm and the largest particle size was not larger than 2.0 μm. The reducing agent complex dispersion obtained was filtered with a polypropylene-made filter having a pore size of 10.0 μm to remove foreign matters such as dusts, etc. and stored.

(Preparation of 10% By Weight Dispersion of Mercapto Compound)

To 5 kg of 1-phenyl-2-heptyl-5-mercapto-1,3,4-triazole and 5 kg of an aqueous solution of 20% by weight modified polyvinyl alcohol (Poval MP203, manufactured by KURARAY CO., LTD.) was added 8.3 kg of water and the mixture was stirred well to form a slurry. The slurry was sent by a diaphragm pump and dispersed by a horizontal sand mill (UVM-2: AIMEX Corporation) packed with zirconia beads having a mean diameter of 0.5 mm for 6 hours, and thereafter, water was added such that the concentration of the mercapto compound became 10% by weight to obtained a mercapto compound dispersion. In the mercapto compounds particles contained in the mercapto compound dispersion thus obtained, the median size was 0.40 μm and the largest particle size was not larger than 2.0 μm. The mercapto compound dispersion obtained was filtered with a polypropylene-made filter having a pore size of 10.0 μm to remove foreign matters such as dusts, etc. and stored. Also, the dispersion was again filtered with a polypropylene-made filter having a pore size of 10.0 μm directly before use.

(Preparation of 20% By Weight Dispersion-1 of Organic Polyhalogen Compound)

A mixture of 5 kg of tribromomethylnaphthylsulfone, 2.5 kg of an aqueous solution of 20% by weight modified polyvinyl alcohol (Poval MP203, manufactured by KURARAY CO., LTD.), 213 g of an aqueous solution of 20% by weight sodium triisopropylnaphthalenesulfonate, and 10 kg of water was mixed well to form a slurry. The slurry was sent by a diaphragm pump and dispersed by a horizontal sand mill (UVM-2: AIMEX Corporation) packed with zirconia beads having a mean diameter of 0.5 mm for 5 hours, and thereafter, 0.2 g of a benzoisothiazolinone sodium salt and water were added to the dispersion such that the concentration of the organic halogen compound became 20% by weight to obtained an organic polyhalogen compound dispersion. In the organic polyhalogen compound particles contained in the organic polyhalogen compound dispersion thus obtained, the median size was 0.36 μm and the largest particle size was not larger than 2.0 μm. The organic polyhalogen compound dispersion obtained was filtered with a polypropylene-made filter having a pore size of 3.0 μm to remove foreign matters such as dusts, etc. and stored.

(Preparation of 25% By Weight Dispersion-2 of Organic Polyhalogen Compound)

By following the same procedure as the case of the 20% by weight dispersion-1 of organic polyhalogen compound except that 5 kg of tribromomethyl(4-(2,4,6-trimethylphenylsulfonyl)phenyl)sulfone was used in place of 5 kg of tribromomethylnaphthylsulfone, an organic polyhalogen compound dispersion was obtained, and the organic polyhalogen compound dispersion was diluted such that the concentration of the compound became 25% by weight and filtered. In the organic polyhalogen compound particles contained in the organic polyhalogen compound dispersion thus obtained, the median size was 0.38 μm and the largest particle size was not larger than 2.0 μm. The organic polyhalogen compound dispersion obtained was filtered with a polypropylene-made filter having a pore size of 3.0 μm to remove foreign matters such as dusts, etc. and stored.

(Preparation of 26% By Weight Dispersion-3 of Organic Polyhalogen Compound)

By following the same procedure as the case of preparing 20% by weight dispersion-1 of organic polyhalogen compound except that 5 kg of tribromomethylphenylsulfone was used in place of 5 kg of tribromomethylnaphthylsulfone, an organic polyhalogen compound dispersion was obtained, and the dispersion was diluted such that the concentration of the organic halogen compound became 26% by weight, and the diluted dispersion was filtered. In the organic polyhalogen compound particles contained in the organic polyhalogen compound dispersion thus obtained, the median size was 0.41 μm and the largest particle size was not larger than 2.0 μm. The organic polyhalogen compound dispersion obtained was filtered with a polypropylene-made filter having a pore size of 3.0 μm to remove foreign matters such as dusts, etc. and stored. Also, after storing, the dispersion was stocked at a temperature of not higher than 10° C. before use.

(Preparation of 25% By Weight Dispersion-4 of Organic Polyhalogen Compound)

By following the same procedure as the case of it preparing 20% by weight dispersion-1 of organic polyhalogen compound except that 5 kg of tribromomethyl-3-pentanoylaminophenylsulfone was used in place of 5 kg of tribromomethylnaphthylsulfone, an organic polyhalogen compound dispersion was obtained, and the dispersion was diluted such that the concentration of the organic halogen compound became 25% by weight, and the diluted dispersion was filtered. In the organic polyhalogen compound particles contained in the organic polyhalogen compound dispersion thus obtained, the median size was 0.41 μm and the largest particle size was not larger than 2.0 μm. The organic polyhalogen compound dispersion obtained was filtered with a polypropylene-made filter having a pore size of 3.0 μm to remove foreign matters such as dusts, etc. and stored.

(Preparation of 5% By Weight Solution of Phthalazine Compound)

In 174.57 kg of water was dissolved 8 kg of modified polyvinyl alcohol MP203, manufactured by KURARAY CO., LTD., and then 3.15 kg of an aqueous solution of 20% by weight sodium triisopropylnaphthalenesulfonate and 14.28 kg of 6-isopropylphthalazine were added to the solution to prepare a solution of 5% by weight 6-isopropylphthalazine.

(Preparation of 20% By Weight Dispersion of Pigment)

To 250 g of water were added 64 g of C.I. Pigment Blue 60 and 6.4 g of Demor N, manufactured by Kao Corporation, and the mixture was mixed well to form a slurry. Then, 800 g of zirconia beads having a mean diameter of 0.5 mm were placed in a vessel together with the slurry and the slurry was dispersed by a dispersing machine (¼ G Sand Grinder Mill, manufactured by AIMEX Corporation) for 25 hours to obtain a pigment dispersion. The pigment particles contained in the pigment dispersion thus obtained had a mean particle size of 0.21 μm.

(Preparation of 40% By Weight SBR Latex)

An ultra-filtration (UF) purified SBR latex was obtained as follows.

The SBR latex described below was diluted to 10 times with distilled water, purified using Module FS03-FC-FUYO3A1 for UF-purification (manufactured by Daisen Membrane System K.K.) until the ionic conductivity became 1.5 mS/cm, and Sundet-BL (manufactured by SANYO CHEMICAL INDUSTRIES, LTD.) was added thereto at 0.22% by weight. Furthermore, NaOH and $NH_4OH$ were added such that $Na^+$ ion:$NH_4^+$ ion=1:2.3 (mol ratio) and the pH was adjusted to 8.4. In this case, the latex concentration was 40% by weight.

(SRB latex; Latex of -St(68)-Bu(29)-AA(3)-, Tg=17° C.)

The mean particle size was 0.1 μm, the concentration was 45% by weight, the equivalent moisture content at 25° C., 60% RH was 0.6% by weight, the ionic conductivity was 4.2 mS/cm (the ionic conductivity was measured using conductivity meter CM-30S, manufactured by Toa Denpa Kogyo K.K., about the latex dope (40% by weight) at 25° C.), and pH was 8.2.

(Preparation of Coating Solution of Emulsion Layer (Light-Sensitive Layer))

To a mixture of 1.1 g of the 20% by weight dispersion of the pigment, 103 g of the fatty acid silver salt dispersion, 5 g of the 20% by weight aqueous solution of polyvinyl alcohol PVA-205 (manufactured by KURARAY CO., LTD.), 5 g of the 25% by weight dispersion of the reducing agent, 16.3 g of the total amounts of 5:1:3 (weight ratio) of the organic polyhalogen compound dispersions-1, -2, and -3, 6.2 g the 10% by weight dispersion of the mercapto compound, 106 g of 40% by weight the SBR latex (Tg; 17° C.) purified by ultrafiltration (UF) and pH adjusted, and 18 ml of the 5% by weight solution of the phthalazine compound, obtained as described above was added 10 g of the silver halide mixed emulsions A directly before coating followed by mixing well to form a coating solution of emulsion layer, the coating solution was sent as it was to a coating die such that the coating amount became 70 ml/m$^2$, and was coated.

The viscosity of the coating solution of emulsion layer measured by a B-type viscometer manufactured by Tokyo Keiki K.K. was 85 (mPa·s) at 40° C. (No. 1 rotor, 60 rpm).

Also, the viscosities of the coating solution at 25° C. measured using an RFS Froude Spectrometer manufactured by Rheometrix Far East Co., in the shear rates of 0.1, 1, 10, 100, and 1000 (1/second) were 1500, 220, 70, 40, and 20 (mPa·s) respectively.

(Preparation of Coating Solution of Emulsion Surface Interlayer)

To 772 g of the 10% by weight aqueous solution of polyvinyl alcohol PVA-205 (manufactured by KURARAY CO., LTD.), 5.3 g of the 20% by weight dispersion of the pigment, and 226 g of the 27.5% by weight solution of the methyl methacrylate/styrene/butyl acrylate/hydroxyethyl methacrylate/acrylic acid copolymer (copolymerization weight ratio 64/9/20/5/2) latex were added 2 ml of the 5% by weight aqueous solution of Aerosol OT (manufactured by American Cyanamid Company), 10.5 ml of the 20% by weight aqueous solution of di-ammonium phthalate, and water to make the total amount 880 g, and the pH of the mixture was adjusted to 7.5 with NaOH to prepare a coating solution of an interlayer, and the coating solution was sent to a coating die such that the coating amount became 10 ml/m$^2$.

The viscosity of the coating solution measured by a B-type viscometer was 21 (mPa·s) at 40° C. (No. 1 rotor, 60 rpm).

(Preparation of Coating Solution of 1st Protective Layer of Emulsion Layer Surface)

In water was dissolved 64 g of inert gelatin, to the gelatin solution formed were added 80 g of the 27.5% by weight solution of the methyl methacrylate/styrene/butyl acrylate/hydroxyethyl methacrylate/acrylic acid copolymer (copolymerization weight ratio 64/9/20/5/2) latex, 23 ml of the 10% by weight methanol solution of phthalic acid, 23 ml of the 10% by weight aqueous solution of 4-methylphthalic acid, 28 ml of sulfuric acid having a concentration of 0.5 mol/liter, 5 ml of the 5% by weight aqueous solution of Aerosol OT (manufactured by American Cyanamid Company), 0.5 g of phenoxy ethanol, and 0.1 g of benzoisothiazolinone, and then water was added to the mixture to make the total amount 750 g to prepare a coating solution, and directly before coating, the coating solution was mixed with 26 ml of 4% by weight chrome alum by a static mixer and sent to a coating die such that the coating amount became 18.6 ml/m$^2$.

The viscosity of the coating solution measured by a B-type viscometer was 17 (mPa·s) at 40° C. (No. 1 rotor, 60 rpm).

(Preparation of Coating Solution of 2nd Protective Layer of Emulsion Layer Surface)

In water was dissolved 80 g of inert gelatin, to the gelatin solution were added 102 g of the 27.5% by weight solution of the methyl methacrylate/styrene/butyl acrylate/hydroxyethyl methacrylate/acrylic acid copolymer (copolymerization weight ratio 64/9/20/5/2) latex, 3.2 ml of the 5% by weight solution of an N-perfluoroctylsulfonyl-N-propylalanine potassium salt, 32 ml of the 2% by weight aqueous solution of polyethylene glycol mono(N-perfluoroctylsulfonyl-N-propyl-2-aminoethyl) ether (ethylene oxide average polymerization degree=15), 23 ml of the 5% by weight solution of Aerosol OT (manufactured by American Cyanamid Company), 4 g of polymethyl methacrylate fine particles (mean particle size 0.7 μm), 21 g of polymethyl methacrylate fine particles (mean particle size 6.4 μm), 1.6 g of 4-methylphthalic acid, 4.8 g of phthalic acid, 44 ml of sulfuric acid having a concentration of 0.5 mol/liter, and 10 ml of benzoisothiazolinone, and water added to the mixture to make the total weight 650 g. Then, directly before coating, the diluted mixture was mixed with 445 ml of an aqueous solution containing 4% by weight chrome alum and 0.67% by weight phthalic acid by a static mixer to provide a coating solution of the surface protective layer and the coating solution was sent to a coating die such that the coating amount became 8.3 ml/m$^2$.

The viscosity of the coating solution measured by a B-type viscometer was 9 (mPa·s) at 40° C. (No. 1 rotor, 60 rpm).

(Preparation of Photothermographic Material-1)

The back surface of the above-described subbed support were simultaneously double coated with the coating solution of an antihalation layer such that the solid component coated amount of the solid fine particle dye became 0.04 g/m$^2$ and the coating solution of the back surface protective layer such that the gelatin coated amount became 1.7 g/m$^2$, followed by drying to form the back layers.

The opposite subbed surface of the support to the back surface were simultaneously multilayer-coated by a slide bead coating system in the order from the subbed surface, an emulsion layer (coated silver amount of the silver halide 0.14 g/m$^2$), an interlayer, a 1st protective layer, and a 2nd protective layer to prepare a sample (Sample No. 1) of the photothermographic material. The coating and drying conditions were as follows.

Coating was carried out at a speed of 160 meters/minute, the gap between the coating die head and the support was from 0.10 to 0.30 mm and the pressure of the reduced-pressure chamber was lowered by 196 to 882 Pa than the atmospheric pressure. The support was static-eliminated by an ionized blast before coating.

After cooling the coated solutions by a blast of a dry-bulb temperature of 10 to 20° C. in the successive chilling zone, the coated support was conveyed by a non-contact type conveyer and dried by a helical non-contact type dryer with a drying blast of a dry-bulb temperature of from 23 to 45° C. and a wet-bulb temperature of from 15 to 21° C.

After drying, the coated layers were subjected to moisture conditioning at 25° C. and a relative humidity of from 40 to 60%, and thereafter, the coated support was heated such that the film surface temperature became from 70 to 90° C. After heating, the coated support was cooled until the film surface became 25° C.

The matted degree of the photothermographic material prepared was 550 seconds at the light-sensitive layer side and 130 seconds at the back surface as the Beck smoothness. Also, the pH of the film surface of the light-sensitive layer surface side was 6.0.

(Preparation of Photothermographic Material-2)

By following the same procedure as the case of the photothermographic material-1 (Sample No. 1) except that the coating solution of the emulsion layer was changed as described below and the yellow dye compound 15 of the antihalation layer was removed, a photothermographic material-2 (Sample No. 2) was prepared.

(Preparation of Coating Solution of Emulsion Layer (Light-Sensitive Layer))

A mixture of 1.1 g of the 20% by weight dispersion of the pigment obtained as described above, 103 g of the fatty acid silver salt dispersion, 5 g of the 20% by weight aqueous solution of polyvinyl alcohol PVA-205 (manufactured by KURARAY CO., LTD.), 26 g pf the 25% by weight dispersion of the reducing agent complex described above, 8.2 g of the total amounts of 1:3 (weight ratio) of the organic polyhalogen compound dispersions-3 and -4, 6.2 g of 10% dispersion of the mercapto compound, 106 g of the SBR latex (the latex of -St(70)-Bu(27)-AA(3)-, Tg: 23° C.) subjected to the ultrafiltration (UF) purification and pH control, and 18 ml of the 5% by weight solution of the phthalazine compound was mixed well with 10 g of the silver halide mixed emulsion A directly before coating to prepare a coating solution of emulsion layer, and the coating solution was sent to a coating die as it was such that the coating amount became 70 ml/m$^2$, and coated.

By following the same procedures as the cases of the sample Nos. 1 and 2 of the photothermographic material except that the same amount of each of the fluorine-based surface active agents shown in Table 1 below was used in place of the N-perfluoroctylsulfonyl-N-propylalanine potassium salt and polyethylene glycol mono(N-perfluorooctylsulfonyl-N-propyl-2-aminoethyl) ether (ethylene oxide average polymerization degree=15) in the protective layer for back surface and the 2nd protective layer of emulsion layer surface, light-sensitive materials 001 to 010 and 011 to 020 were prepared.

TABLE 1

| Sample No. | Base Formula | Fluorine-based Surface Active Agent | White Spots | Note |
|---|---|---|---|---|
| 1 | 1 | Described before | 8 | Comparison |
| 2 | 2 | Described before | 7 | Comparison |
| 001 | 1 | FC-1 | 10 | Comparison |
| 002 | 1 | FC-2 | 9 | Comparison |
| 003 | 1 | FC-3 | 11 | Comparison |
| 004 | 1 | FS-18 | 3 | Invention |
| 005 | 1 | FS-19 | 3 | Invention |
| 006 | 1 | FS-21 | 2 | Invention |
| 007 | 1 | FS-26 | 4 | Invention |
| 008 | 1 | FS-38 | 3 | Invention |
| 009 | 1 | FS-39 | 3 | Invention |
| 010 | 1 | FS-41 | 2 | Invention |
| 011 | 2 | FC-1 | 9 | Comparison |
| 012 | 2 | FC-2 | 8 | Comparison |
| 013 | 2 | FC-3 | 10 | Comparison |
| 014 | 2 | FS-18 | 2 | Invention |
| 015 | 2 | FS-19 | 1 | Invention |
| 016 | 2 | FS-20 | 1 | Invention |
| 017 | 2 | FS-22 | 2 | Invention |
| 018 | 2 | FS-27 | 3 | Invention |
| 019 | 2 | FS-38 | 2 | Invention |
| 020 | 2 | FS-40 | 1 | Invention |

(Evaluation of Photographic Performance)

Each sample was uniformly exposed by Fuji Medical Dry Laser Imager FM-DP L (mounted with a 660 nm semiconductor laser of the maximum output 60 mW (IIIB)) such that the density of the photographic material became about 2.0, and heat developed (at about 120° C.). The sample obtained was visually observed on a Shaukasten and the number of white spots was determined. The results are shown in Table 1.

From the results of Table 1, it can be seen that by using the fluorine-based surface active agents used in the invention, the occurrence of white spots can be remarkably reduced.

EXAMPLE 2

In place of the light-sensitive materials 001 to 020 of Example 1, samples wherein the reducing agents of the formula (I) were changed to 11, 14, and 27 (the structures are described in the specification) were prepared and the same evaluations as Example 1 were carried out. In this case, it was confirmed that by using the fluorine-based surface active agents used in the invention, the number of white spots was reduced.

According to the invention, it becomes possible to provide the photothermographic material excellent in the heat developing property and the image stock stability, wherein attaching of foreign matters such as dusts, etc., which cause the white sport failure after heat development, is remarkably prevented.

While the invention has been described in detail and with reference to specific embodiments thereof, it will be apparent to one skilled in the art that various changes and modifications can be made therein without departing from the spirit and scope thereof.

What is claimed is:

1. A photothermographic material comprising a support having provided on one surface thereof at least one kind of light-sensitive silver halide, a light-insensitive organic silver salt, a reducing agent for silver ions, and a binder, wherein the photothermographic material comprises a surface active agent represented by the following formula (F):

(F)

$$[Rf—(Rc)_n]_m—Z$$

wherein Rf represents a perfluoroalkyl group, Rc represents an alkylene group, Z represents a group having an anionic group, a cationic group, a betaine-series group, or a nonionic polar group necessary for imparting a surface activity, n represents 1, and m represents an integer of 1, 2 or 3, and wherein the photothermographic material comprises a color toning agent, which is a combination of a phthalazine compound and a phthalic acid compound.

2. The photothermographic material according to claim 1, wherein said reducing agent is a reducing agent represented by the following formula (I):

(I)

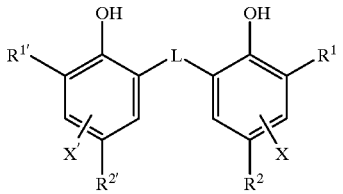

wherein $R^1$ and $R^{1'}$ each independently represents an alkyl group having from 1 to 20 carbon atoms, $R^2$ and $R^{2'}$ each independently represents a hydrogen atom, or a substituent capable of being substituted to the benzene ring, L represents an —S— group or a —$CHR^3$— group, wherein $R^3$ represents a hydrogen atom or an alkyl group having from 1 to 20 carbon atoms, and X and X' each independently represents a hydrogen atom or a substituent capable of being substituted to the benzene ring.

3. The photothermographic material according to claim 1, wherein the photothermographic material comprises the compound represented by the following formula (II):

(II)

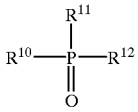

wherein $R^{10}$, $R^{11}$, and $R^{12}$ each independently represents an alkyl group, an aralkyl group, an aryl group, an alkoxy group, an aryloxy group, an amino group, or a heterocyclic group.

4. The photothermographic material according to claim 1, wherein the photothermographic material comprises the compound represented by the following formula (III):

$$Q—(Y)_n—C(Z^1)(Z^2)X \quad \text{(III)}$$

wherein Q represents an alkyl group, an aryl group, or a heterocyclic group, Y represents a divalent connecting group, n represents 0 or 1, $Z^1$ and $Z^2$ each represents a halogen atom, and X represents a hydrogen atom or an electron attractive group.

5. The photothermographic material according to claim 1, wherein in formula (F), Rc represents an alkylene group of 1 to 20 carbon atoms and n is 1.

6. The photothermographic material according to claim 1, wherein the phthalazine compound is at least one selected from the group consisting of phthalazine, 4-(1-naphthyl) phthalazine, 6-isopropylphthalazile, 6-t-butylphthalazine, 6-chlorophthalazine, 5,7-dimethoxyphthalazine, 2,3-dihydrophthalazine and metal salts thereof; and wherein the phthalic acid compound is at least one selected from the group consisting of phthalic acid, 4-methylphthalic acid, 4-nitrophthalic acid and tetrachlorophthalic acid anhydride.

7. The photothermographic material according to claim 1, wherein in formula (F), Rc represents an alkylene group of 2 to 20 carbon atoms and n is 1.

* * * * *